US006280107B2

(12) United States Patent
Watanabe et al.

(10) Patent No.: US 6,280,107 B2
(45) **Date of Patent: *Aug. 28, 2001**

(54) PEELING DEVICE, TAPE PROCESSING DEVICE INCORPORATING THE PEELING DEVICE, AND TAPE PRINTING APPARATUS INCORPORATING THE TAPE PROCESSING DEVICE

(75) Inventors: Kenji Watanabe; Takanobu Kameda; Tomoyuki Shimmura; Tomohiro Moriya, all of Tokyo; Noriyuki Kamijo, Nagano, all of (JP)

(73) Assignees: Seiko Epson Corporation; King Jim Co., Ltd., both of Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/454,544

(22) Filed: Dec. 7, 1999

Related U.S. Application Data

(62) Division of application No. 08/965,385, filed on Nov. 6, 1997.

(30) Foreign Application Priority Data

Nov. 7, 1996 (JP) ..... 8-311488
Nov. 7, 1996 (JP) ..... 8-311489

(51) Int. Cl.[7] ..... B41J 11/26

(52) U.S. Cl. ..... 400/615.2; 400/621; 400/586

(58) Field of Search ..... 400/615.2, 586, 400/621, 593; 156/344, 584

(56) References Cited

U.S. PATENT DOCUMENTS 3,028,280 4/1962 Hoffman ..... 156/584

(List continued on next page.)

FOREIGN PATENT DOCUMENTS 0383157 8/1990 (EP) .
416802A1 3/1991 (EP) .

(List continued on next page.)

*Primary Examiner*—John S. Hilten
*Assistant Examiner*—Minh H. Chau
(74) *Attorney, Agent, or Firm*—Hogan & Hartson, LLP

(57) ABSTRACT

A peeling device according to one aspect of the invention peels off part of a peel-off paper from a peel-off paper-backed adhesive tape which is a laminate of a substrate tape having a surface coated with an adhesive and a peel-off paper affixed to the substrate tape via the adhesive. A rotational member is rotated by a driving force transmitted from a drive source. On an end face of the rotational member there are arranged a peeling projection rotated to be brought into contact with a substrate tape-side surface of an end of the peel-off paper-backed adhesive tape to carry out a bending releasing action on said end portion of the adhesive tape. The adhesive tape is guided toward the peeling projection when it is inserted and part of the end portion other than a free end brought to the peeling projection is held. In a tape processing device for processing a peel-off paper-backed adhesive tape, according to another aspect of the invention, a trimming mechanism trims one end of the peel-off paper-backed adhesive tape, while a peeling mechanism peels off a peel-off paper from the peel-off paper-backed adhesive tape. The driving force is transmitted to the trimming mechanism and the peeling mechanism from a simple drive force. There is also provided a tape printing apparatus incorporating the tape processing device.

16 Claims, 15 Drawing Sheets

U.S. PATENT DOCUMENTS

| | | | | |
|---|---|---|---|---|
| 3,106,324 | | 10/1963 | Fritzinger | 156/584 |
| 3,266,797 | | 8/1966 | Stievenart | 156/584 |
| 3,533,616 | | 10/1970 | Bettenhausen | 156/584 |
| 3,755,049 | | 8/1973 | Leloux | 156/584 |
| 3,951,727 | | 4/1976 | Greenberg | 156/584 |
| 4,173,510 | | 11/1979 | Tobey | 156/584 |
| 4,216,048 | | 8/1980 | Gehweiler | 156/344 |
| 4,927,278 | * | 5/1990 | Kuzuya et al. | 400/208 |
| 4,940,506 | | 7/1990 | Krause | 156/584 |
| 5,117,719 | * | 6/1992 | Takagi et al. | 83/640 |
| 5,254,200 | | 10/1993 | Takagi | 156/344 |
| 5,295,753 | * | 3/1994 | Godo et al. | 400/612 |
| 5,460,681 | | 10/1995 | Horner | 156/344 |
| 5,569,354 | | 10/1996 | Day | 156/584 |
| 5,653,850 | | 8/1997 | Watanabe | 156/584 |
| 5,658,416 | | 8/1997 | MacCollum et al. | 156/344 |
| 5,824,184 | | 10/1998 | Kamijo et al. | 156/584 |
| 5,937,725 | * | 8/1999 | Kamijo et al. | 83/880 |

FOREIGN PATENT DOCUMENTS

| | | |
|---|---|---|
| 0506257 | 9/1992 | (EP) . |
| 611722A2 | 8/1994 | (EP) . |
| 634277A2 | 1/1995 | (EP) . |
| 719620A2 | 7/1997 | (EP) . |
| 56147212 | 4/1980 | (JP) . |
| 5798837 | 12/1980 | (JP) . |
| 5820252 | 8/1981 | (JP) . |
| 5823854 | 8/1981 | (JP) . |
| 56161161 | 12/1981 | (JP) . |
| 5958891 | 4/1984 | (JP) . |
| 60100362 | 7/1985 | (JP) . |
| 63171768 | 7/1988 | (JP) . |
| 3287397 | 12/1991 | (JP) . |
| 4294734 | 10/1992 | (JP) . |
| 5169749 | 7/1993 | (JP) . |

* cited by examiner

PEELING DEVICE, TAPE PROCESSING DEVICE INCORPORATING THE PEELING DEVICE, AND TAPE PRINTING APPARATUS INCORPORATING THE TAPE PROCESSING DEVICE

This is a division of application Ser. No. 08/965,385 filed Nov. 6, 1997, which application is hereby incorporated by reference in its entirety.

BACKGROUND OF THE INVENTION

1. Field of the Invention

This invention relates to a peeling device for peeling e.g. a peel-off paper from a peel-off paper-backed adhesive tape, a tape processing device including the peeling device and a trimming device for trimming e.g. an end of the peel-off paper-backed adhesive tape in the form of a label e.g. into one with a radius, and a tape printing apparatus incorporating the tape processing device.

2. Prior Art

As a conventional trimming device of the above-mentioned kind, one for being mounted in a tape printing apparatus has been proposed e.g. by Japanese Laid-Open Patent Publication (Kokai) No. 3-28739. In this tape printing apparatus, there is mounted a trimming device conforming to the tape width of a peel-off paper-backed adhesive tape to be trimmed, and the trimming device is replaced by another according to a change in the tape width of a tape employed. The trimming device is comprised of a cutter unit for trimming an end of a strip of peel-off paper-backed adhesive tape and a guide member for guiding the strip inserted therein to the cutter unit. The strip of the peel-off paper-backed adhesive tape, which has desired characters and figures printed thereon and has been delivered out of the tape printing apparatus, is inserted into this trimming device, whereby an end of the peel-off paper-backed tape is automatically trimmed to have corners thereof formed into ones with a radius.

On the other hand, as a conventional peeling device of the above-mentioned kind, a peeling device has been proposed e.g. by Japanese Laid-Open Patent Publication (Kokai) No. 5-169749. The proposed peeling device is provided as an attachment to a tape printing apparatus, and useful in effecting a permanent deformation of part of a peel-off paper-backed adhesive tape by sandwiching a corner portion thereof between a punch and a die of the device. A substrate tape and a peel-off paper as components of the peel-off paper-backed adhesive tape restore their shapes differently to respective permanently deformed shapes due to a difference in their materials, so that the punching causes the peel-off paper to be slightly peeled at a portion thereof from the substrate tape. The resulting slightly separated or peeled portion is used as a portion for seizure by the user when he peels the peel-off paper off the substrate tape.

In the proposed peeling device, however, it is required to determine an area and depth of hitting of the punch on the die by taking into account the rigidity of the substrate tape and that of the peel-off paper, the difference in rigidity between them, and adhesion of the adhesive to the peel-off paper, so that the peeling cannot be effected with sufficient reliability which meets the demand of the users. Further, since not only the peel-off paper but also the substrate tape is permanently deformed, the substrate tape acquires a so-called bent property, which makes the substrate tape affixed to an object liable to have pebbling or easy to be removed from the object.

Further, since the trimming device and the peeling device do not operate at the same time, when they are simply mounted e.g. in a tape printing apparatus, it is expected that they are provided with respective drive sources, such as motors. This results in duplication of components of the tape printing apparatus, resulting in increased size and manufacturing costs of the whole apparatus.

SUMMARY OF THE INVENTION

It is a first object of this invention to provide a peeling device which is capable of carrying out a peeling operation for peeling off the peel-off paper from an adhesive tape with high reliability and efficiency.

It is a second object of this invention to provide a tape processing device in which a trimming mechanism and a peeling mechanism share as many component parts as possible to thereby attain reduction of size and manufacturing costs, and a tape printing apparatus incorporating the tape processing device.

To attain the first object, according to a first aspect of the invention, there is provided a peeling device for peeling off part of a peel-off paper from an adhesive tape, the adhesive tape being formed of a laminate of a substrate tape having one surface thereof coated with an adhesive and the peel-off paper affixed to the substrate tape via the adhesive, the peeling device comprising:

a drive source for generating a driving force;

a rotational member for being rotated by the driving force transmitted from the drive source;

a peeling projection arranged on an end face of the rotational member and rotated to be brought into contact with a substrate tape-side surface of an end of the adhesive tape to carry out a bending and releasing action on the end of the adhesive tape; and holding means for guiding the adhesive tape inserted therein to the peeling projection and for holding part of the end of the adhesive tape other than a free end portion of the end, which is brought to the peeling projection.

According to this peeling device, when an end of the adhesive tape is brought through the holding means to the peeling projection rotated by the rotational member, a free end portion of the end of the adhesive tape repeatedly receives a bending and releasing action from the peeling projection. Since the peeling projection rotated is brought into contact with a substrate tape-side surface of the end of the adhesive tape, the free end portion of the end of the adhesive tape is bent with the substrate tape-side surface being positioned outward and the peel-off paper-side surface being positioned inward. A radius of curvature (R) of this bend is smaller on the peel-off paper-side and larger on the substrate tape-side, which causes an interlayer slip to occur between the substrate tape and the peel-off paper against adhesion of the adhesive. Further, by this interlayer slip, the end of the peel-off paper is slightly protruded from that of the substrate tape. As a result, when the peeling projection bends the adhesive tape with the largest bending angle and thereafter releases the same, the end of the peeling projection first leaves the substrate tape and then with a very short delay it leaves the peel-off paper. When the end of the peeling projection leaves the substrate tape, it still catches the peel-off paper, whereas the released (free end of) substrate tape starts to return from the state bent together with the adhesive to an original linear state thereof. At this time point, if the spring force of the substrate tape exceeds the adhesion of the adhesive for affixing the peel-off paper to the substrate tape, the peel-off paper starts to be peeled (at this portion) from the substrate tape. Even if the peel-off paper is not peeled off, since the adhesion of the adhesive is reduced, the peel-off paper is eventually removed from the substrate tape after peeling actions repeatedly effected thereon. Further, if the bend is within the limit of elastic deformation of (the free end of) the substrate tape and within the range of permanent deformation of (the free end of) the peel-off paper, after the bending operation is canceled, the substrate tape recovers its original shape, whereas the peel-off paper remains as bent, and hence does not adhere to the substrate tape again. On the other hand, the peeling projection is arranged on an end face of the rotational member and hence the end of the substrate tape can be brought deep enough toward the center or rotation axis of the rotational member, whereby the whole peeling device can be made more compact in construction than when the peeling projection is formed on the peripheral surface of the rotational member.

Preferably, the peeling projection is rotated to be brought into contact with the free end portion of the end of the adhesive tape in a manner such that the contact is made continuously from a tip side toward a root side of the free end portion of the end of the adhesive tape.

According to this preferred embodiment, the free end portion of the end of the adhesive tape is bent progressively from a portion having a smaller affixing area of the adhesive to a portion having a larger affixing area of the adhesive. That is, the peeling action is carried out on the adhesive tape from a portion easier to peel off toward a portion harder to peel off. The adhesion of the adhesive to the peel-off paper is relatively small and therefore when the adhesion of the adhesive alone is considered, the peel-off paper is easy to remove, but actually it is difficult to make a peel-off start portion where the peeling has already occurred. However, the peel-off start portion can be easily made by carrying out the peeling action on the peel-off paper-backed adhesive tape from the portion easier to peel off to the portion harder to peel off, whereby it is possible to accelerate the peeling of the peel-off paper at the free end portion of the end of the adhesive tape. The above-mentioned manner of contact between the peeling projection and the adhesive tape is made possible by inclining or bending (contact surface of) the peeling projection with respect to the direction of radius of the movable member when the end of the adhesive tape is brought to the rotation axis of the rotational member, or alternatively by bring the end of the adhesive tape toward a position slightly deviating from the rotating axis of the rotational member assuming that the (contact surface of the) peeling projection is arranged in a manner extending radially from the rotating axis thereof. Further, when the peeling is carried out by axially bringing the end of the adhesive tape to the peeling projection, the peeling projection should be formed in a manner inclined or curved with respect to the direction of the radius of the rotational member.

Preferably, the holding means has a side guide wall for guiding the adhesive tape in a manner such that a side of the end of the adhesive tape is inserted along the end face of the rotational member.

The end of the adhesive tape is easiest to peel off at a corner thereof, and hence to bring the corner into rotating contact with the peeling projections, in the case of a typical peeling device, it is required to bring the adhesive tape in a manner inclined with respect to the peeling projection. According to the above construction of the preferred embodiment, however, it is possible to bring one corner of the end of the adhesive tape inserted toward the rotation axis of the rotational member into contact with the peeling projection being rotated (the contact made with the peeling projection being rotated will be referred to hereinafter as "rotating contact"). In other words, even if the end of the adhesive tape is brought to the peeling projection in parallel therewith, the one corner of the inserted end of the adhesive tape can be brought into rotating contact with the peeling projection. This makes it possible to simplify the construction of the peeling device, and at the same time dispenses with the trouble the user takes of inserting the adhesive tape in an inclined manner.

Preferably, the holding means has a pair of face guide walls for guiding the adhesive tape in a manner such that the end of the adhesive tape is inserted in a manner bent toward a front side and a reverse side with respect to a direction of insertion.

According to this preferred embodiment, the end of the adhesive tape is bent whereby the rigidity of the adhesive tape enables the holding means to hold the adhesive tape. That is, the adhesive tape is caused to be held by the holding means simply by inserting the same therein without using a special component part for retaining the adhesive tape, and it is possible to smoothly insert or withdraw the adhesive tape into or from the holding means.

Preferably, a portion of the holding means opposite to the side guide wall is open to the outside.

According to this preferred embodiment, it is possible to easily withdraw a adhesive tape having a peeled-off portion from the holding means in an opposite direction to a direction of the side guide wall. Further, differently from a device in which the adhesive tape is withdrawn from curved holding means in an opposite direction to a direction of insertion of the adhesive tape, the peeled portion of the peel-off paper is prevented form adhering to the substrate tape again. Moreover, it is possible to insert and peel off various kinds of adhesive tapes irrespective of their tape widths.

Preferably, at least one of the pair of face guide walls located on a peel-off paper-side has a sloped portion provided at an end thereof opposed to the peeling projection in a manner such that a corner of the end of the adhesive tape forms the free end portion.

According to this preferred embodiment, a corner of the end of the adhesive tape easiest to peel off can be brought to the peeling projection as a free end simply by inserting the adhesive tape into the holding means.

Preferably, the peeling projection has an end formed in parallel with the sloped portion opposed thereto.

According to this preferred embodiment, it is possible to bend a corner (free end) of the end of the adhesive tape uniformly and adequately to thereby stabilize the peeling function of the peeling device.

Preferably, a condition expressed by the following formula is fulfilled:

$$t \leq \delta \leq 10t$$

where $\delta$ represents a gap between the end of the peeling projection and the sloped portion parallel therewith and t represents a width of the adhesive tape.

Preferably, the peeling projection is formed by a plurality of peeling projecting pieces substantially radially arranged on the end face of the rotational member, the plurality of peeling projecting pieces having longer projecting pieces and shorter projecting pieces in a mixed manner.

According to this preferred embodiment, the longer projecting pieces bend the whole free end of the end of the adhesive tape, while the shorter projecting pieces bend a tip portion of the free end of the same. This enables the peeling device peels a portion of e.g. even an adhesive tape hard to peel off by a combination of the longer projecting pieces and the shorter projecting pieces, the longer projecting pieces reducing or weakening the adhesion of the adhesive of the whole free end and the shorter projecting pieces intensively act on the tip of the free end where the adhesive tape is easiest to peel off. Therefore, a peel-off start portion where the adhesive tape has started to be peeled off can be more easily made, and the peeling of the adhesive tape can be further accelerated.

Preferably, the peeling device further includes drive control means for causing the drive source to generate the driving force before the end of the adhesive tape is inserted inward of a rotation locus of the peeling projection.

More preferably, the drive control means is opposed to the holding means for detecting the end of the adhesive tape when the adhesive tape is inserted into the holding means, and thereby causing the drive source to generate the driving force.

According to these preferred embodiments, the drive control means starts driving the drive source to generate the driving force when the adhesive tape is inserted to an intermediate point, so that when the end of the adhesive tape reaches the peeling projection, the peeling projection has already been rotating. Therefore, the end of the adhesive tape is progressively inserted inward of the rotation locus of the rotational member so that the tip of a portion eventually forming the free end is the first to receive the peeling action of the peeling projection.

To attain the second object, according to a second aspect of the invention, there is provided a tape processing device for processing a peel-off paper-backed adhesive tape, the tape processing device comprising:

a trimming mechanism for trimming an end of the peel-off paper-backed adhesive tape;

a peeling mechanism for peeling off a peel-off paper from the peel-off paper-backed adhesive tape;

single driving means for driving the trimming mechanism and the peeling mechanism; and driving force-transmitting means for transmitting driving force from the driving means to the trimming mechanism and the peeling mechanism.

According to this tape processing device, the driving force of the driving means is transmitted in a bifurcated manner by the driving force-transmitting means in two directions, i.e. to the trimming mechanism and the peeling mechanism. This enables the trimming mechanism to trim corners of the end of a cut-off strip of the peel-off paper-backed adhesive tape, and the peeling mechanism to make a peel-off start portion of the cut-off strip. That is, the trimming mechanism and the peeling mechanism can be operated by the single driving means. In other words, the trimming mechanism and the peeling mechanism can share the driving source.

Preferably, the driving means includes a drive shaft and a motor for rotating the drive shaft, the driving force-transmitting means has a one-way clutch having an input-side thereof fixed to the drive shaft and an output-side thereof connected to the trimming mechanism to thereby transmit only torque in a normal direction to the trimming mechanism.

According to this preferred embodiment, when the motor rotes in the normal direction, the driving force is transmitted by the driving force-transmitting means to the trimming mechanism and the peeling mechanism to cause both the mechanisms to operate, whereas when the motor rotates in the reverse direction, the one-way clutch inhibits the driving force from being transmitted to the trimming mechanism but only the peeling mechanism alone is caused to operate. Therefore, when the peeling mechanism is operated, no load of the trimming mechanism is applied to the motor. Compared with the load of the trimming mechanism for trimming corners of the cut-off strip of the peel-off paper-backed adhesive tape, load of the peeling mechanism for peeling a portion of the cut-off strip is much smaller. That is, during idling of the peeling mechanism, which receives small idling load, the trimming mechanism is put into operation to trim corners of the cut-off strip, whereas when the peeling mechanism operates to carry out its peeling operation, the trimming mechanism which receives large idling load is completely inhibited from operating, whereby the load on the motor as a whole is reduced.

Preferably, the one-way clutch comprises a first gear fixed to the drive shaft, a second gear mated with the first gear, an output wheel arranged coaxially with the second gear with an output-side thereof being connected to the trimming mechanism, and a clutch body interposed between the second gear and the output wheel to transmit only the torque in the normal direction from the motor to the trimming mechanism.

According to this preferred embodiment, if the driving force transmitted from the first gear to the second gear is one for the normal rotation, it is transmitted from the second gear through the clutch body to the output wheel, thereby putting the trimming mechanism into operation. On the other hand, when the driving force is one for the reverse rotation, the clutch inhibits the driving force from being transmitted from the second gear to the output wheel. Further, since the output wheel is provided coaxially with the second gear, the clutch can be easily constructed in a concentric form with respect to the drive shaft.

Preferably, the clutch body has a ratchet wheel arranged on one of the second gear and the output wheel, a ratchet pawl pivotally arranged on another of the second gear and the output wheel for being mated with the ratchet wheel, and a spring urging the ratchet pawl in a mating direction.

According to this preferred embodiment, the clutch mechanism which is very simple in construction but operates with accuracy can be constructed by using the ratchet wheel and ratchet pawl.

Preferably, the trimming mechanism includes a crank mechanism for converting rotation of the output wheel into reciprocation, and a cutter actuated by the reciprocation of the crank mechanism, for a cutting operation.

According to this preferred embodiment, a cutter which carries out the whole process of its cutting operation by its reciprocating motion can be formed by the crank mechanism. That is, the cutter whose movable blade translates or rotates can be constructed.

Preferably, the first gear further includes an output block for transmitting both the torque in the normal direction and torque in a reverse direction from the motor to the peeling mechanism.

According to this preferred embodiment, the driving force for the normal or reverse rotation can be transmitted to the peeling mechanism by a simple construction which utilizes the first gear. The output block per se may integrate the one-way clutch or otherwise the one-way clutch is interposed between the output block and the peeling mechanism whereby the peeling mechanism may be caused to operate only when the motor rotates in the reverse direction.

More preferably, the one-way clutch comprises an input-side face ratchet fixed to the drive shaft and an output-side face ratchet rotatably and axially slidably supported on the drive shaft.

According to this preferred embodiment, the one-way clutch can be formed by one having a simple construction. Further, when the input-side face ratchet rotates in the normal direction, the saw-tooth shape of the face ratchets enables the output-side face ratchet to be rotated in the normal direction without any free rotation of the input-side face ratchet in a disengaged state, whereby the driving force is positively transmitted from the input side to the output side, whereas when the input-side face ratchet rotates in the reverse direction, the saw-tooth shape of the face ratchets causes the output-side face ratchet to be flicked by the input-side face ratchet, whereby the ratchets are instantaneously disconnected from each other to smoothly cut off the transmission of the driving force.

Preferably, the output-side face ratchet has a worm on an output-side thereof, the trimming mechanism having a worm wheel mated with the worm on an input-side thereof, and a viscous material is filled between the drive shaft and the worm, for causing the worm to rotate in a free-running manner with rotation of the drive shaft.

According to this preferred embodiment, when the input-side face ratchet rotates in unison with the drive shaft, the worm of the output-side face ratchet rotates in a free-running manner with the drive shaft when both the face ratchets are not engaged with each other. At this time, the worm tries to rotate the worm wheel of the trimming mechanism mated therewith, but the worm wheel does not rotate due to load of the trimming mechanism. As a result, the worm moves downward while rotating in a free-running manner based on the mechanism of the screw pair of the worm and the worm wheel (which applies the force in a thrust direction). This brings the output-side face ratchet into engagement with the input-side face ratchet, whereby the driving force of the input-side face ratchet is permitted to be transmitted to the output-side face ratchet, and the trimming mechanism is operated by the driving force transmitted via the output side face ratchet. On the other hand, when the input-side face ratchet rotates in unison with the drive shaft in the reverse direction, the input-side face ratchet flicks the output-side face ratchet outwardly, and the worm integrally formed with the flicked output-side face ratchet rotates in a free-running manner with the drive shaft to axially move away from the input-side face ratchet. This cuts off the transmission of the driving force from the input-side face ratchet to the output-side face ratchet.

Preferably, the tape processing device further includes a stopper for limiting movement of the worm in an axial direction in a manner such that the worm is mated with the worm wheel in a state in which the input-side face ratchet and the output-side face ratchet are disengaged from each other.

According to this preferred embodiment, after the input-side face ratchet and the output side face ratchet are disengaged from each other, the worm of the output-side face ratchet is limited by the axial movement by the stopper, and at the same time, the worm wheel serves as the resistance to rotation to stop the worm against the force applied via the viscous material. In this state, the stopper holds the worm and the worm wheel in the mated state, and thereafter, when the drive shaft rotates in the normal direction, the worm axially moves while rotating in a free-running manner with the drive shaft, as described above, to bring the output-side face ratchet into engagement with the input-side face ratchet. In short, the output-side face ratchet and the input-side face ratchet can be engaged or disengaged automatically according to the normal or reverse rotation of the drive shaft.

Preferably, the trimming mechanism includes a crank mechanism for converting rotation of the worm wheel into reciprocation, and a cutter actuated by the reciprocation of the crack mechanism, for a cutting operation.

According to this preferred embodiment, the cutter which carries out the process of its cutting operation by its reciprocating motion can be formed by the crank mechanism. That is, the cutter having the movable blade which translates or rotates can be formed. When the movable blade is moved, the cutter can be designed to be a scissors-like one, whereby the cutting performance having excellent durability and stability can be formed.

Preferably, the input-side face ratchet further includes an output block for transmitting both the torque in the normal direction and torque in a reverse direction from the motor to the peeling mechanism.

According to this preferred embodiment, the normal or reverse rotation of the motor can be transmitted to the peeling mechanism by a simple construction utilizing the input-side face ratchet. The output block per se may integrate the one-way clutch or otherwise the one-way clutch is interposed between the output block and the peeling mechanism whereby the peeling mechanism may be caused to operate only when the motor rotates in the reverse direction.

Preferably, the tape processing device further includes a device casing formed with a trimming guide slit for guiding the peel-off paper-backed adhesive tape inserted therein to the trimming mechanism and a peeling guide slit for guiding the peel-off paper-backed adhesive tape inserted therein to the peeling mechanism, the trimming guide slit and the peeling guide slit being arranged adjacent to each other.

According to this preferred embodiment, to trim the cut-off strip of the inserted peel-off paper-backed adhesive tape, the cut-off strip is inserted into the trimming guide slit of the device casing, whereas to peel the same, it is inserted into the peeling guide slit of the device casing. That is, depending on the kind of treatment required for the cut-off strip of the tape, a different insertion slit is used. This prevents the user from making a mistake in carrying out the treatment desired on the cut-off strip. Further, since the trimming guide slit and the peeling guide slit are arranged adjacent to each other, it is possible to intensively arrange the working areas for the both kinds of treatment of the cut-off strip, and at the same time, the path for transmitting the driving force by the driving force-transmitting mechanism to the trimming mechanism and the peeling mechanism can be shortened, to thereby simplify the construction of the driving force-transmitting mechanism.

Preferably, the trimming guide slit and the peeling guide slit are different in direction of inserting the peel-off paper-backed adhesive tape.

According to this preferred embodiment, the user is required to be conscious of direction of insertion of the cut-off strip of the peel-off paper backed adhesive tape when the strip is inserted into the trimming guide slit for trimming and when the same is inserted into the peeling guide slit for peeling. This makes the user less likely to make a mistake in effecting the treatment therefor.

Preferably, the tape processing device further includes normal rotation control means for detecting the peel-off paper-backed adhesive tape inserted into the trimming guide slit to thereby cause the motor to rotate in a normal direction.

According to the preferred embodiment, when the cut-off strip of the peel-off paper-backed tape is inserted into the trimming guide slit, the normal rotation control means detects the insertion and causes the motor to rotate in the normal direction. Therefore, simply by inserting the cut-off strip into the trimming guide slit, i.e. without necessitating any other operation, the trimming of the cut-off strip can be carried out.

Preferably, the tape processing device further includes inverse rotation control means for detecting the peel-off paper-backed adhesive tape inserted into the peeling guide slit to thereby cause the motor to rotate in a reverse direction.

According to the preferred embodiment, when the cut-off strip of the peel-off paper-backed tape is inserted into the peeling guide slit, the reverse rotation control means detects the insertion and causes the motor to rotate in the normal direction. Therefore, simply by inserting the cut-off strip into the peeling guide slit, i.e. without necessitating any other operation, the peeling of the cut-off strip can be carried out.

To attain the second object, according to a third aspect of the invention, there is provided a tape printing apparatus which is capable of using a peel-off paper-backed adhesive tape, the tape printing apparatus comprising:

printing means for printing the peel-off paper-backed adhesive tape;

cutter means for cutting off the peel-off paper-backed adhesive tape to a predetermined length;

tape-feeding means for bringing the peel-off paper-backed adhesive tape printed by the printing means to the cutter means and sending the peel-off paper-backed adhesive tape out of the tape printing apparatus; and a tape processing device for processing the peel-off paper-backed adhesive tape cut to the predetermined length, the tape processing device including:

a trimming mechanism for trimming an end of the peel-off paper-backed adhesive tape cut to the predetermined length, a peeling mechanism for peeling off a peel-off paper from the peel-off paper-backed adhesive tape cut to the predetermined length, single driving means for driving the trimming mechanism and the peeling mechanism, and driving force-transmitting means for transmitting driving force from the driving means to the trimming mechanism and the peeling mechanism.

According to the tape printing apparatus, which is capable of carrying out printing on the peel-off paper-backed adhesive tape, cutting of the same, and delivering the cut-off strip out of the apparatus, and at the same time, the cut-off strip which is printed can be trimmed and peeled by the same apparatus. Therefore, from the peel-off paper-backed adhesive tape, labels which can be affixed to a desired object, with excellent appearance, can be formed with ease.

The above and other objects, features, and advantages of the invention will become more apparent from the following detailed description taken in conjunction with the accompanying drawings.

DETAILED DESCRIPTION

The invention will now be described in detail with reference to drawings showing embodiments thereof. In these embodiments, a tape processing device and a tape printing apparatus incorporating the tape processing device according to the invention are applied to a tape printing apparatus for printing desired characters and figures on a peel-off paper-backed printing tape (tape) and cutting off the printed portion of the printing tape to a predetermined length to thereby form a separate piece of the printed portion in the form of a label. This tape printing apparatus also has the functions of trimming each corner of the printed portion of the printing tape T in the form of a label into one with a radius, and peeling off part of a peel-off paper at a corner of the printed portion in the form of a label.

Figure 1:
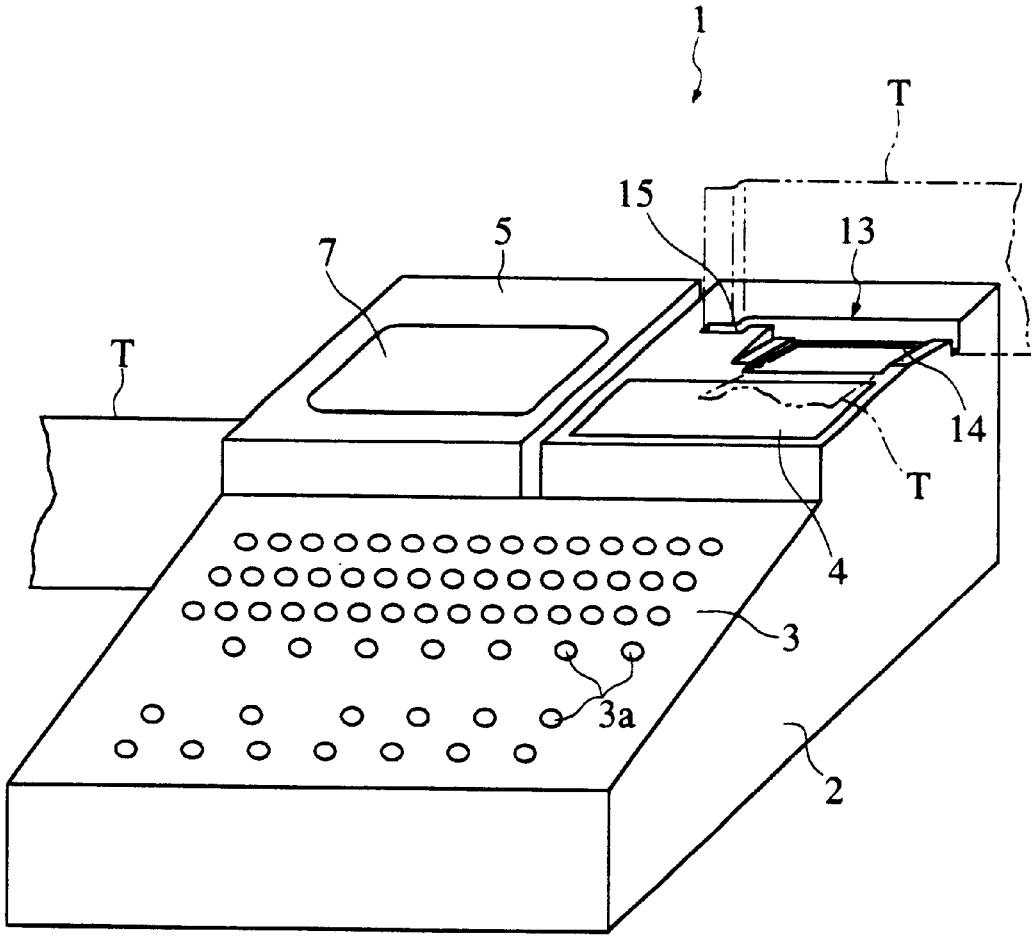
FIG. 1 is a perspective view of an appearance of a tape printing apparatus according to an embodiment of the invention.
Figure 2:
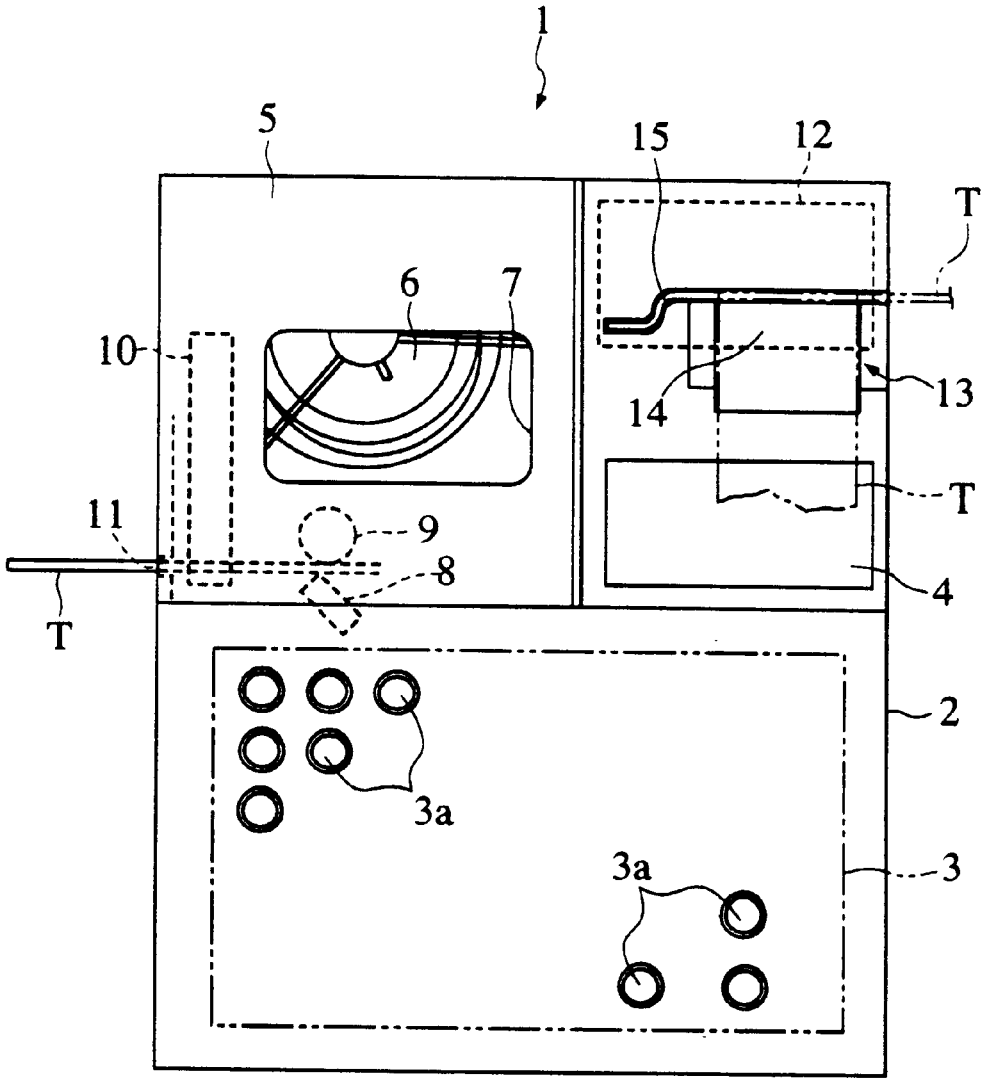
FIG. 2 is a plan view of a tape printing apparatus according to the embodiment.

FIG. 1 is a perspective view of the tape printing apparatus and FIG. 2 is a plan view of the same. As shown in the figures, the tape printing apparatus 1 is comprised of an apparatus casing 2 housing component parts therein, an input block 3 having a plurality of input keys 3*a* arranged on a front-side of the apparatus casing 2, a display 4 arranged on a rear side of the apparatus casing 2, and a lid 5 which can be opened and closed. Under the lid 5, there is loaded a tape cartridge 6 containing a printing tape T. Whether the tape cartridge 6 is loaded can be confirmed by viewing the same via a transparent window 7 formed in the lid 5.

Further, a print head 8 forming printing means is arranged under the lid 5 in its closed state at a location close to the tape cartridge 6 loaded, and a platen roller 9 forming tape-feeding means is arranged within the tape cartridge 6 in a manner opposed to the print head 8. The printing tape T is rolled out from the tape cartridge 6 by the platen roller 9, printed by the print head 8, and further sent out of the apparatus 1. Further, at a location close to a left side of the tape cartridge 6 as viewed in FIG. 2, the apparatus casing 2 contains a cutter mechanism (cutting means) 10. The apparatus casing 2 is formed with a tape exit 11 at a location adjacent to the cutter mechanism 10, via which the printing tape T is sent out of the apparatus. The printing tape T is printed and sent out of the apparatus via the tape exit 11, and when the printing is completed, the feeding of the printing tape T is stopped, whereupon the cutter mechanism 10 is driven to cut the printing tape T to a predetermined length (printed portion+leading and trailing marginal areas).

On the other hand, at the rear of the display 4, the apparatus casing 2 contains a tape processing device 12 for trimming corners of the printing tape T into ones with a radius and peeling off a peel-off paper c from the printing tape T. Further, the apparatus casing 2 is formed with a tape-inserting slit 13 in a manner corresponding to the tape processing device 12, for sending an end portion of the printing tape T into the tape processing device 12. The tape-inserting slit 13 is formed by a tape-trimming guide slit 14 sloping down into the inside of the apparatus casing 2 and a tape-peeling guide slit 15 integral with the tape-trimming guide slit 14, which is formed in a manner crossing the tape-trimming guide slit 14. When the printing tape T is inserted into the tape-trimming guide slit 14, the tape processing device 12 is driven for trimming each corner of the printing tape T into one with a radius. Similarly, when the printing tape T is inserted into the tape-peeling guide slit 15, the tape processing device 12 is driven for peeling off the peel-off paper c at a corner of an end of the printing tape T.

The tape-printing apparatus 1 is operated in the following manner: First, the lid 5 is opened to load the tape cartridge 6 within the apparatus casing 2, and then the lid 5 is closed. Then, a power switch, not shown, is turned on, and characters to be printed are input from the input block 3. A line or lines of the input characters are subjected to character conversion, as needed, and a predetermined key 3*a* is operated to instruct the execution of printing. In response to the instruction, the print head 8 prints the printing tape T being rolled out from the tape cartridge 6 with the line or lines of characters. As the printing proceeds, the printing tape T is advanced by the platen roller 9 until the printed portion of the printing tape T is sent out of the apparatus via the tape exit 11. When the printing is completed, the feeding of the printing tape T is stopped. Then, the cutter mechanism 10 is driven for cutting the printing tape T.

On the other hand, when the resulting cut-off strip of the printing tape T is inserted into the tape-trimming guide slit 14, each corner of the cut-off strip is trimmed into one with a radius. The width of the opening of the tape-trimming guide slit 14 corresponds to the width of a maximum-width printing tape T, so that when the maximum width printing tape T is inserted into the tape-trimming guide slit 14, both corners of an end of the cut-off strip are trimmed at the same time, whereas when a printing tape T narrower in width is inserted, the cut-off strip is moved in the direction of the width of the tape-trimming guide slit 14 to trim corners of an end of the cut-off strip one by one. Further, the cut-off strip is turned around to insert the other end of the cut-off strip into the tape-trimming guide slit 14, and corners of the other end are trimmed to complete trimming of all the corners of the cut-off strip. When the cut-off strip is inserted into the tape-peeling guide slit 15 assuming that trimming will not be carried out, a peel-off paper c is peeled off at a corner of an end of the cut-off strip. This peeled-off portion is used as a handhold for peeling off the pee-off paper from the cut-off strip, whereby it is possible to affix the cut-off strip of the printing tape T to an affixing object as a label.

Figure 9:
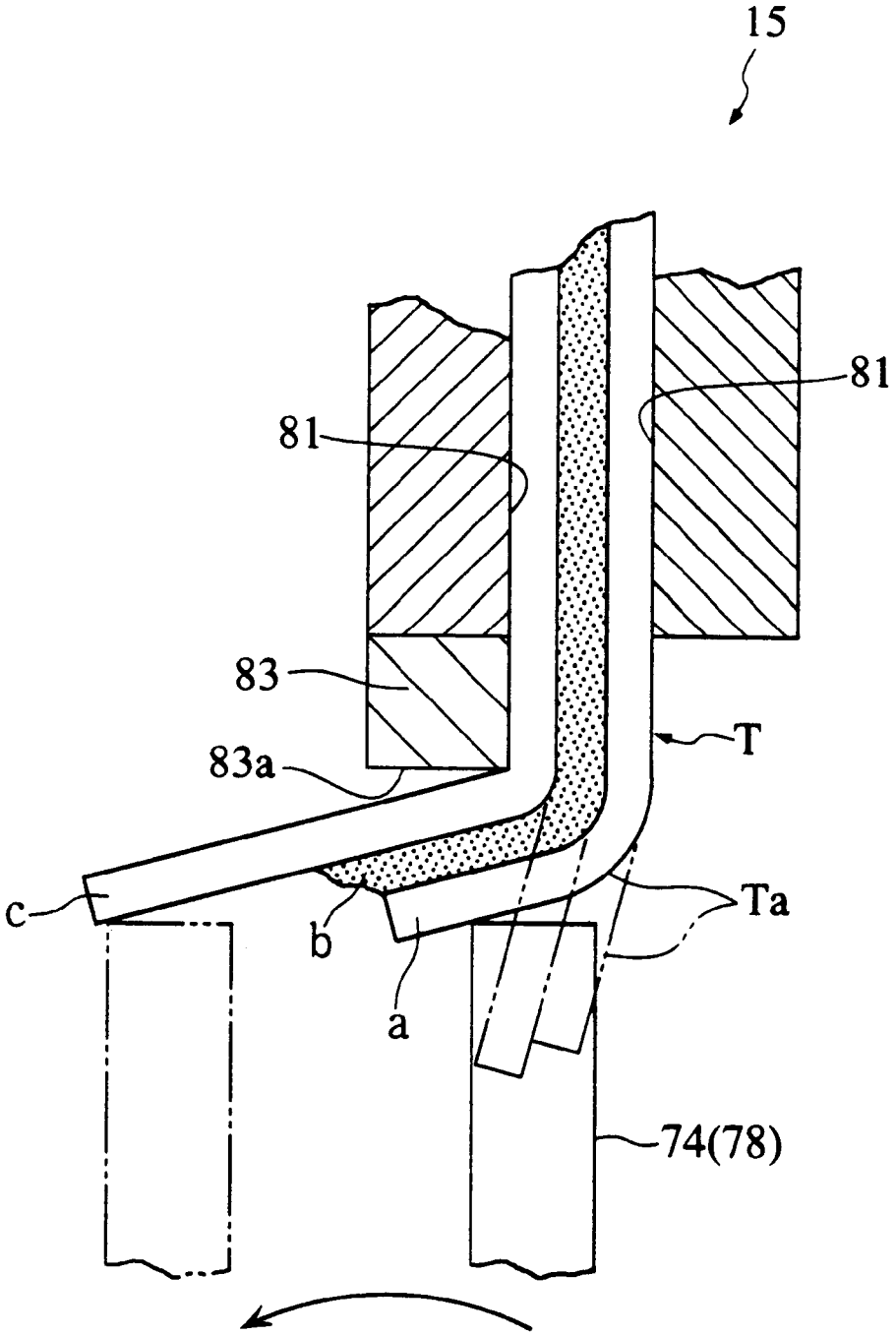
FIG. 9 is an enlarged plan view which is useful in explaining how the peel-off paper starts to be peeled off from the printing tape.

The printing tape T is a so-called peel-off paper-backed adhesive tape, which is comprised of a substrate tape a having a back thereof coated with an adhesive b, and a peel-off paper c affixed to the substrate tape a via the adhesive b (see FIG. 9). The substrate tape a may be made of a vinyl chloride resin, a polypropylene resin or the like, and in the present embodiment, it is made of polyethylene terephthalate (PET), while the peel-off paper c is formed of paper treated with silicone so as to make the same easy to remove. There are provided several kinds of printing tape T, with various tape widths e.g. of 24 mm, 18 mm, 12 mm, and 9 mm, each of which is supplied as a roll received within a tape cartridge 6 therefor.

Figure 3:
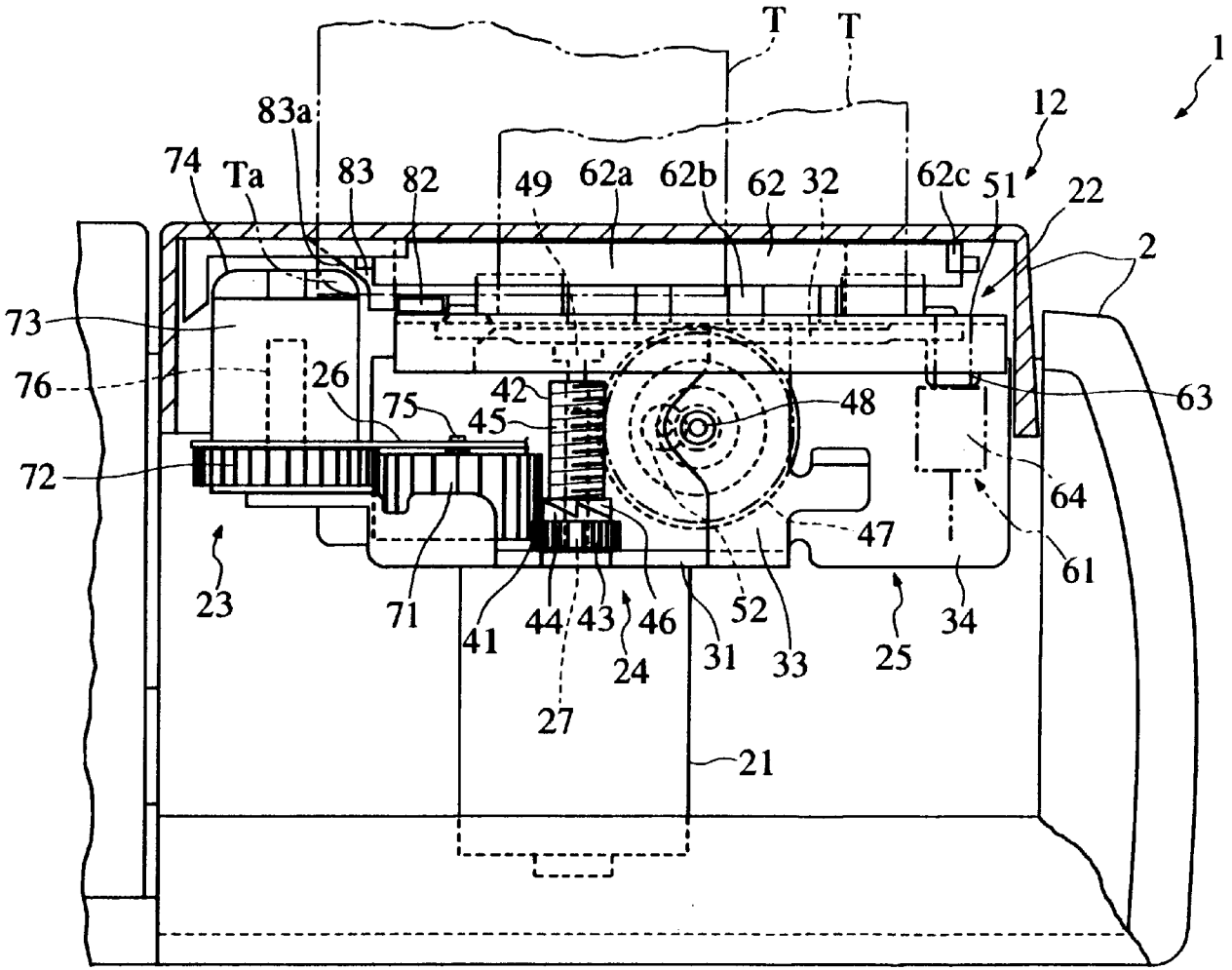
FIG. 3 is a front view showing component parts of a tape processing device incorporated in the tape printing apparatus.
Figure 4:
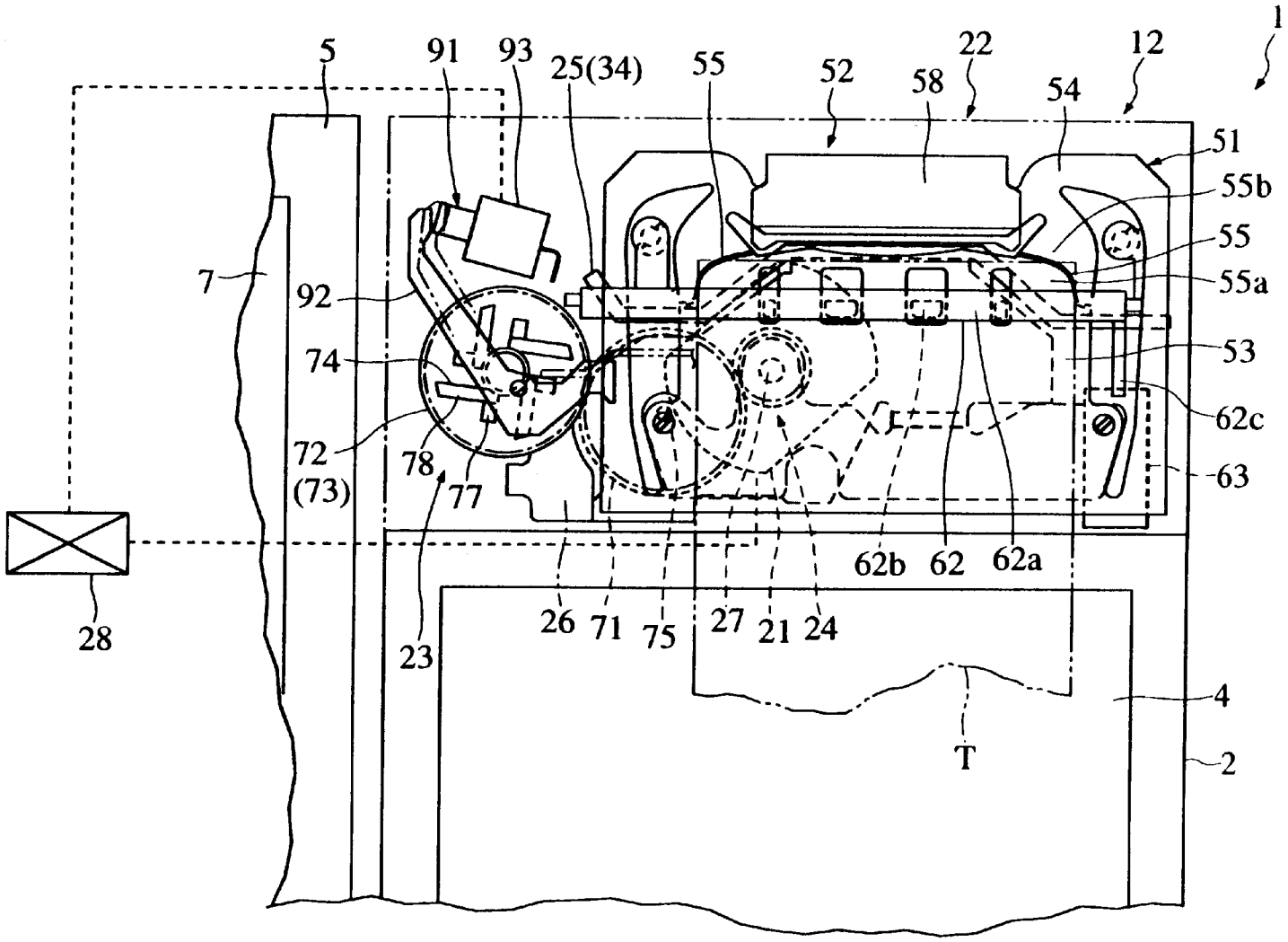
FIG. 4 is a plan view showing component parts of the tape processing device incorporated in the tape printing apparatus.
Figure 5:
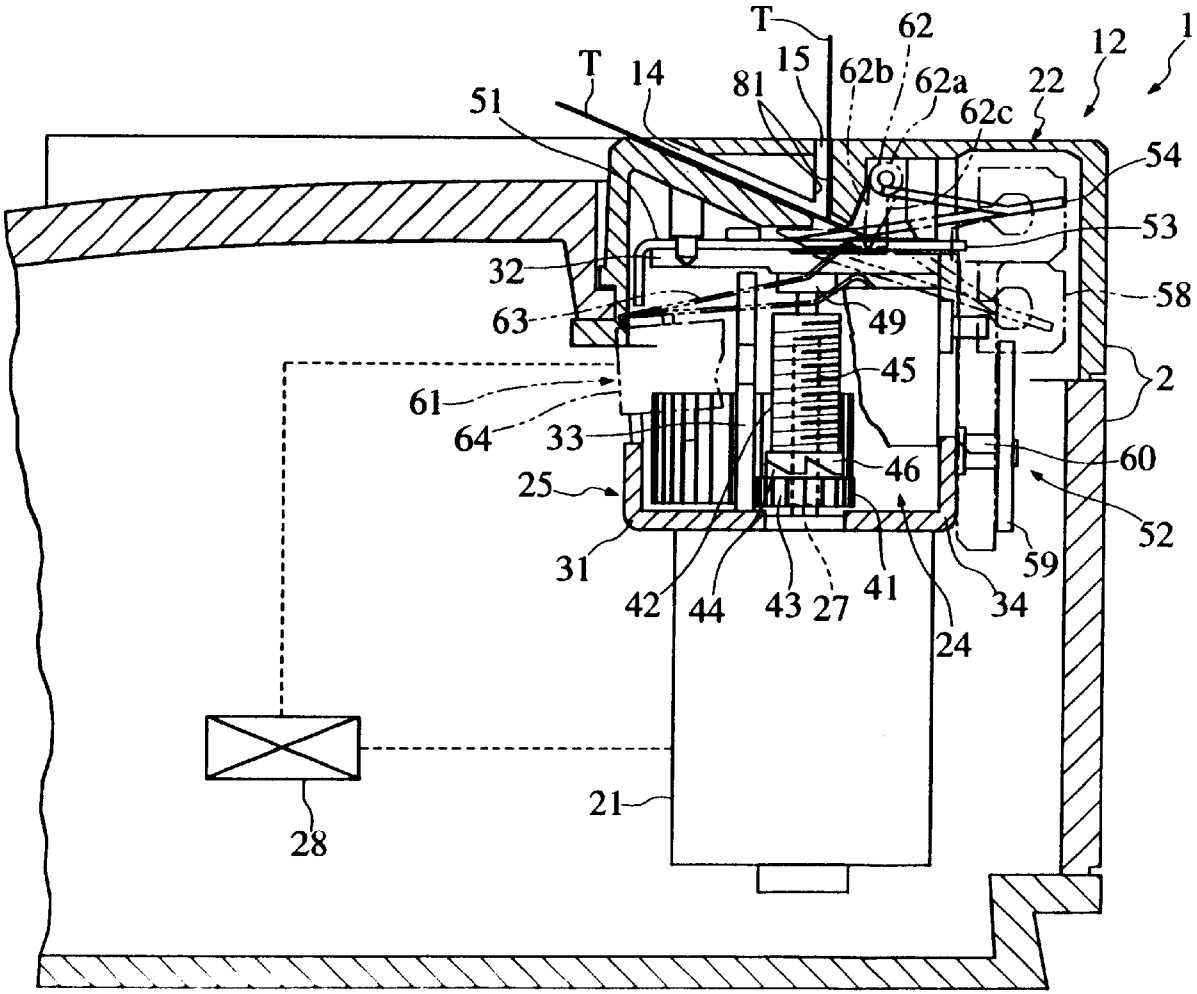
FIG. 5 is a right side view showing component parts of the tape processing device incorporated in the tape printing apparatus.

Next, the tape processing device 12 will be described in detail with reference to FIGS. 3 to 5. FIG. 3 is a front view showing the tape processing device 12 and component parts associated therewith, and FIGS. 4 and 5 are a plan view, and a right side view showing the same, respectively. As shown in these figures, the tape processing device is comprised of a motor (driving means) 21 which is capable of rotating in both directions, a trimming mechanism 22 for trimming corners of the ends of the printing tape T, a peeling mechanism 23 for peeling off part of the peel-off paper c from the printing tape T, a clutch mechanism (driving force-transmitting means) 24 for transmitting a driving force from the motor 21 to the trimming mechanism 22 and the peeling mechanism 23, and a main frame 25 and a subframe 26 for supporting the above component parts. The motor 21 rotates in a normal direction when a trimming switch 61, referred to hereinafter is, turned on, and in a reverse direction when a peeling switch 91, referred to hereinafter, is turned on. The turning force or torque from the motor 21 is transmitted to the trimming mechanism 22 and the peeling mechanism 23 in a manner bifurcated by the clutch 24. The clutch mechanism 24 engages or disengages in response to the normal or reverse rotation of the motor 21 utilized as a trigger, whereby when the motor rotates in the normal direction, the turning or driving force is transmitted to both the trimming mechanism 22 and the peeling mechanism 23, whereas when the motor rotates in the reverse direction, the driving force is transmitted to the peeling mechanism 23 alone.

The main frame 25 is comprised of a lower frame 31, an upper frame 32 arranged in parallel with the lower frame 31 in a manner spaced from the same by a gap, a connecting frame 33 connecting the lower frame 31 and the upper frame 32, and a back frame 34 arranged in parallel with the connecting frame 33. Further, the subframe 26 is interposed between the lower frame 31 and the upper frame 32 in parallel therewith. The motor 21 is supported by the lower frame 31, the trimming mechanism 22 is supported by the connecting frame 33 and the back frame 34, and the peeling mechanism is supported by the lower frame 31 and the subframe 26.

The motor 21 is mounted on the lower frame 31 from underside thereof such that a drive shaft 27 thereof extends through the lower frame 31 to the vicinity of the upper frame 32. The above-mentioned clutch mechanism 24 is assembled with this drive shaft 27.

The clutch mechanism 24 is comprised of an input-side clutch 41 rigidly fitted on the drive shaft 27 of the motor 21, and an output-side clutch 42 rotatably and axially slidably supported on the drive shaft 27 of the motor 21. The input-side clutch 41 is arranged on a portion of the drive shaft 27 close to the lower frame 31, and is comprised of a gear 43 for transmitting the driving force from the motor 21 to the peeling mechanism 23 and an input-side face ratchet 44 integrally formed with the gear 43, which is protruded upward from an end surface of the gear 43. The output-side clutch 42 is arranged on a portion of the drive shaft 27 closer to the upper frame 32-side and is comprised of a worm 45 for transmitting the driving force from the motor 21 to the trimming mechanism 22 and an output-side face ratchet 46 integrally formed with the worm 45, which is protruded downward from an end face of the worm 45. Further, fat or oil of high viscosity (lightly-engaging means), such as grease, is filled between the worm 45 (output-side clutch 42) and the drive shaft 27, whereby the worm 45 (output-side clutch 42) rotate with rotation of the drive shaft 27.

The input-side face ratchet 44 and the output-side face ratchet 46 are arranged opposed to each other, and these ratchets are brought closer to be engaged (mated) with each other, whereby the driving force from the motor 21 is transmitted to the trimming mechanism 22, whereas when the ratchets are separated from each other, i.e. disengaged from each other, the transmission of the driving force to the trimming mechanism 22 is cut off. More specifically, when the input-side face ratchet 44 rotates in a normal direction in a state in which the input-side face ratchet 44 and the output-side face ratchet 46 are engaged with each other, the engaged state of the ratchets is maintained whereby the driving force is transmitted to the trimming mechanism 22, whereas when the input-side face ratchet 44 rotates in a reverse direction, the output-side face ratchet 46 is flicked by the input-side face ratchet 44 to be disengaged therefrom whereby the transmission of the driving force is cut off.

On the other hand, the above-mentioned worm 45 is mated with a worm wheel (intermediate transmitting means) 47 serving as an idle gear of the trimming mechanism 22. The worm wheel 47 is integrally formed with a crank wheel 56, referred to hereinafter, and rotatably supported on a shaft member 48 extending rearward from the connecting frame 33. Further, the upper frame 32 has a stopper 49 formed thereon, which projects downward, coaxially with the drive shaft 27. The stopper 49 has a reduced-diameter portion freely inserted into an upper end of the worm 45. The stopper 49 sets limits to the upward movement of the worm 45, whereby a mated state of the worm 45 and the worm wheel 47 is always maintained. Further, a washer or the like can be mounted in the reduced-diameter portion of the stopper 49 for fine adjustment of a position limiting the upward movement of the worm 45.

In the clutch mechanism 24 constructed as above, when the drive shaft 27 is rotated in the normal direction by the motor 21, the input-side clutch 41 is rotated in the normal direction, and at the same time the output-side clutch 42 is rotated in a free-running manner with rotation through the viscosity of grease. Since the worm 45 of the output-side clutch 42 is mated with the worm wheel 47, the worm 45 acts to rotate the worm wheel 47 and receive a reaction force from the same which is under a load of the trimming mechanism 22. Accordingly, based on the mechanism of a screw pair of the worm 45 and the worm wheel 47, the output-side clutch 42 (worm 45) rotates slowly in a free-running manner with rotation of the drive shaft 27 to move downward on the drive shaft 27 until it abuts against the input-side clutch 41. When the output-side clutch 42 abuts against the input-side clutch 41, the input-side face ratchet 44 and the output-side face ratchet 46 are engaged with each other to establish connection between the output-side clutch 42 and the input-side clutch 41. As a result, the torque from the motor 21 is transmitted to the trimming mechanism 22 via the output-side clutch 42 and the worm wheel 47.

Inversely, when the drive shaft 27 is rotated in a reverse direction by the motor 21, the output-side face ratchet 46 is flicked by the input-side face ratchet 44, and inversely to the above description, based on the mechanism of the screw pair of the worm 45 and the worm wheel 47, the output-side clutch 42 (worm 45) rotates slowly in a free-funning manner with rotation of the drive shaft 27 to move upward on the drive shaft 27 until it abuts against the stopper 49. During this process, the output-side clutch 42 is completely disengaged from the input-side clutch 41 to whereby the transmission of the driving force to the trimming mechanism 22 is cut off. On the other hand, the output-side clutch 42 which has abutted against the stopper 49 receives viscous drag of grease to eventually stop rotation thereof. It should be noted that the driving force is transmitted to the peeling mechanism 23 by the gear 43 of the input-side clutch 41 regardless of whether the drive shaft 27 rotates in the normal direction or in the reverse direction.

As described above, according to the clutch mechanism 24 of the present embodiment, through combination of a clutch comprised of the input-side face ratchet 44 and the output-side face ratchet 46, and a worm gear comprised of the worm 45 and the worm wheel 47, it is possible to automatically engage or disengage the face ratchets 44, 46 in response to normal or reverse rotation of the motor 21. Needless to say, it is possible to engage or disengage the face ratchets 44, 46 by using a spring or urging rod for urging the output-side face ratchet 46 against the input-side face ratchet 44 as in a conventional clutch mechanism. In the clutch mechanism of the present embodiment, however, in contrast to the case of employing a spring, the face ratchets 44, 46 are completely separated from each other when the driving force is cut off and hence a clatter (noise) generated by the face ratchets 44, 46 or abrasion of the face ratchets 44, 46 can be prevented. Further, in contrast to the case of employing an urging rod, a mechanism for activating the rod can be omitted. Therefore, the clutch mechanism of the present embodiment can reduce noise produced by operating the mechanism and have improved durability through simple construction thereof.

Further, the operating load of the trimming mechanism 22 is large even when trimming is not being carried out (i.e. the trimming mechanism is idle), whereas that of the peeling mechanism 23 is very small, when peeling operation is not being carried out (i.e. the peeling mechanism is idle) and hence only when the peeling mechanism 23 is operated to carry out the peeling operation, the transmission of driving force to the trimming mechanism 22 is inhibited, which makes it possible to adequately reduce load on the motor in a simplified manner. Further, although the manufacturing costs are increased, the peeling mechanism 23 may be also provided with this kind of clutch mechanism 24.

Figure 11:
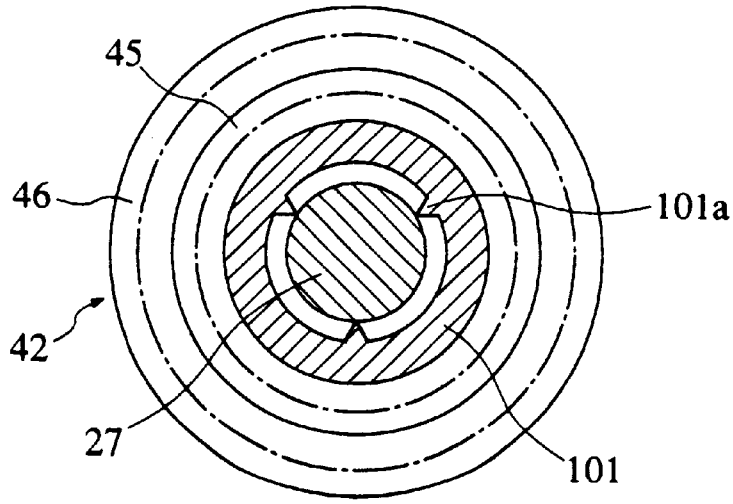
FIG. 11 is an enlarged sectional view showing a first variation of lightly-engaging means together with a worm and component parts associated therewith.

Next, variations of lightly-engaging means other than fats and oils of high viscosity such as grease will be described with reference to FIGS. 11 and 12. In a first variation of FIG. 11, there is interposed a resin collar 101 between the worm 45 (output-side clutch 42) and the drive shaft 27. The collar 101 has an inner peripheral surface formed with three clamping protrusions 110*a*, 110*a*, 101*a* serving as substitutes for oils and fats. Each clamping protrusion 101*a* is in contact with the drive shaft 27 and causes the worm 45 (output-side clutch 42) to be rotated with rotation of the drive shaft 27.

Figure 12:
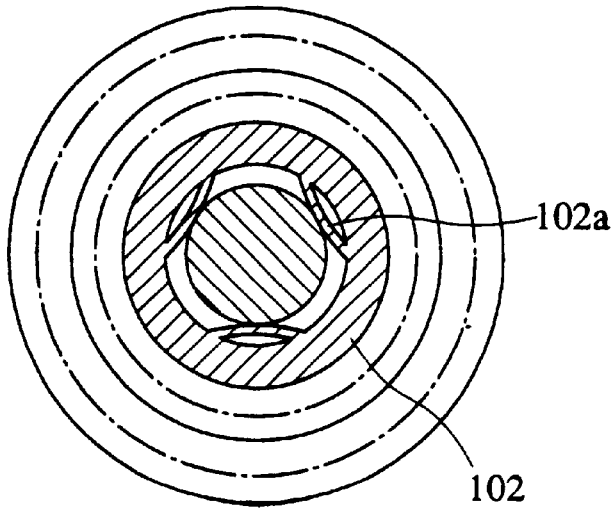
FIG. 12 is an enlarged sectional view showing a second variation of lightly-engaging means together with the worm and component parts associated therewith.

Similarly, in a second variation of FIG. 12, between the worm 45 (output-side clutch 42) and the drive shaft 27, there is interposed a resin collar 102 which has three spring pieces 102*a*, 102*a*, 102*a* integrally formed on an inner peripheral surface thereof. Each spring piece is in lightly-urging contact with the drive shaft 27, and causes the worm 45

(output-side clutch 42) to rotate with rotation of the drive shaft 27. In this case, metal spring pieces formed as separate members may be incorporated. Further, the collar 101, 102 per se may be integrally formed with the worm 45 (output-side clutch 42).

Next, the trimming mechanism 22 will be described. Referring to FIGS. 3 to 5, the trimming mechanism 22 is comprised of a cutter 51 in the form of a plate, arranged in a manner covering the above-mentioned clutch mechanism 24 from above, and a crank mechanism 52 for causing the cutter 51 to carry out a cutting operation.

The cutter 51 is comprised of a fixed blade 53 and a movable blade 54 both formed by blanking and bending of a thin stainless steel plate or the like having resilient properties. More specifically, a thin square plate is formed with a cutout, including a pair of trimming portions (formed with cutting edges) 55, 55 cut to form just a clearance for sliding of the cutting edges past each other, such that the cutout generally takes the shape of the letter U. The fixed blade 53 is formed by a portion inward of the cutout and the movable blade 54 by a portion outward of the same. The fixed blade 53 has a rear side portion thereof mounted on top of the back frame 34 and a front-side thereof screwed onto the upper frame 32, whereas the movable blade 54 is connected to the crank mechanism 52 at a central part of a rear side portion thereof.

The pair of trimming portions 55, 55 are used for trimming each corner of the tape T facing them into one with a radius. Each trimming portion is comprised of a cutting edge 55*a* in an arcuate shape formed on the fixed blade 53 and a cutting edge 55*b* of the movable blade 54, which is of a complementary shape to the cutting edge 55*a*. A portion including each cutting edge 55*b* of the movable blade 54 is bent in a manner twisted perpendicularly upward such that when the movable blade 54 performs a cutting operation (pivotal movement) in a vertical direction about a front end thereof, these cutting edges 55*b* of the movable blade 54 slide past the cutting edges 55*a* of the fixed blade 53. And the pair of trimming portions 55, 55 are arranged in the apparatus casing 2 in a manner opposed to the above-mentioned tape-trimming guide slit 14.

Figure 6:
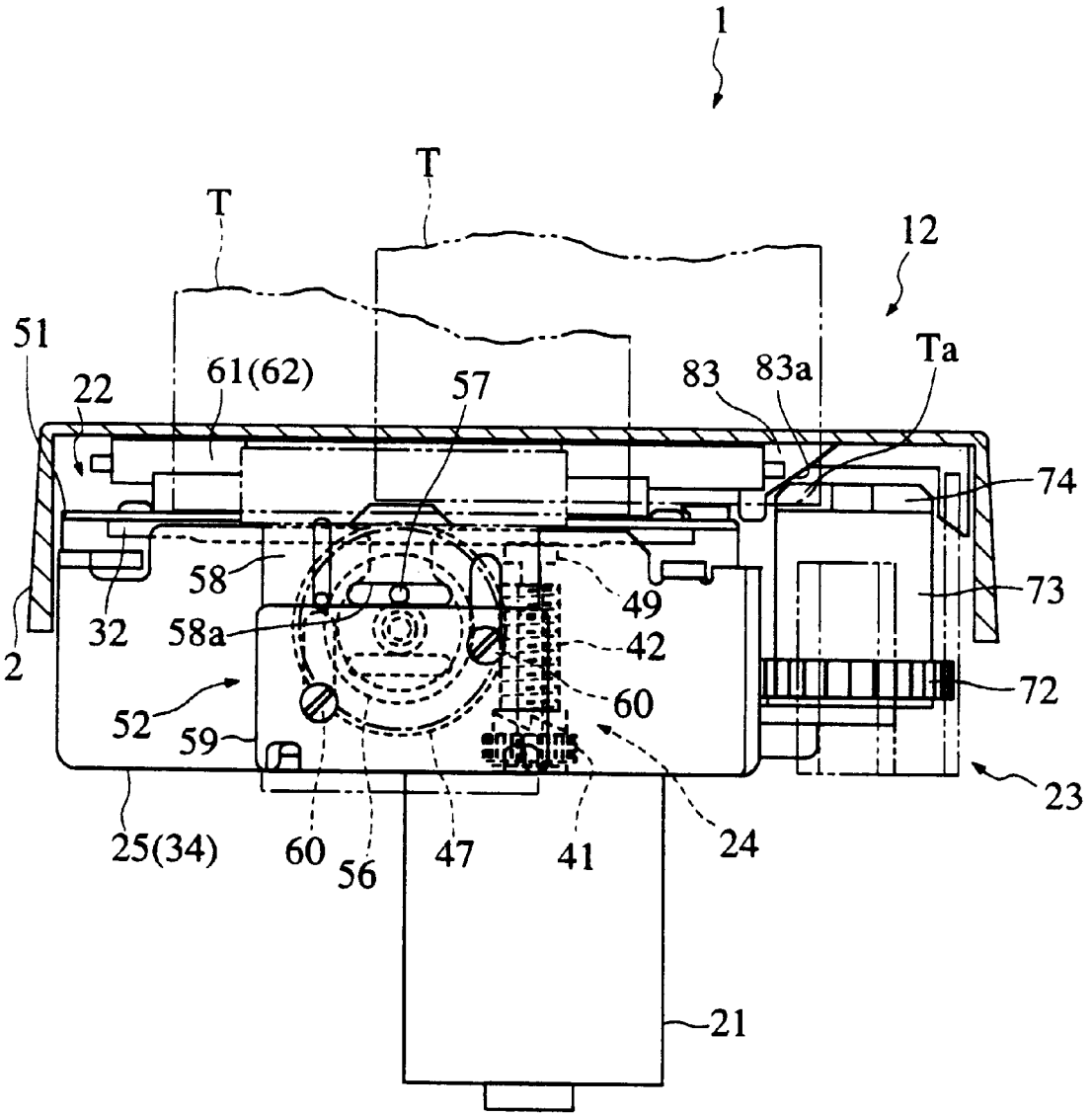
FIG. 6 is a rear elevational view showing component parts of the tape processing device incorporated in the tape printing apparatus.

As shown in the rear elevational view of FIG. 6, the crank mechanism 52 is constituted by a crank wheel 56 integrally formed with the above worm wheel 47, an eccentric pin 57 projected from a front-side surface of the crank wheel 56, and a slider 58 having an elongate slot 58*a* engaged with the eccentric pin 57. The slider 58 is sandwiched between the back frame 34 and a guide plate 59 arranged in the back of the back frame 34, and at the same time slidably guided in a vertical direction by two guide pins 60, 60 formed between the back frame 34 and the guide plate 59. To an upper part of the slider 58 there is fixed a rear part of the movable blade 54 in a manner inserted therein. The slider 58 perpendicularly slides to cause the-movable blade 54 to perform the cutting operation in a vertical direction.

The elongate slot 58*a* formed in the slider 58*a* extends longitudinally or in the direction of the width of the tape printing apparatus, and the eccentric pin 57 rotated (revolved) by the crank wheel 56 causes the slider 58 to move in a vertical direction while longitudinally sliding inside the elongate slot 58*a,* which constitutes the crank mechanism for converting a rotating motion into a reciprocating motion. The trimming mechanism 22 thus constructed is further provided with a trimming switch (normal rotation control means) 61 for normally rotating the motor 21 so as to start the cutter 51 when the printing tape T is inserted into the tape-trimming guide slit 14.

The trimming switch 61 is comprised, as shown in FIG. 5, of a pivot arm 62 facing a front or lower end of the tape-trimming guide slit 14, a switch arm 63 having one end in contact with the pivot arm 62, and a switch body 64 in contact with a portion close to a root end of the switch arm 63. The pivot arm 62 is formed of a body 62*a* having a columnar shape and pivotally supported by the apparatus casing 2, a plurality of receiving portions 62*b* formed on axially intermediate portions of the body 62*a,* and a pushing portion 62*c* arranged at an axial end of the body 62*a* (see FIGS. 3, 4 and 5). The receiving portions 62*b* face the lower end of the tape-trimming guide slit 14, whereas the pushing portion 62*c* is in contact with the ones of the switch arm 63. When the printing tape T is inserted into the tape-trimming guide slit 14, the receiving portions 62*b* are pushed by the printing tape T, whereby the pushing portion 62*c* is caused to pivot about the body 62*a* to push down the switch arm 63.

The switch arm 63 is formed of a leaf spring having the root end thereof fixed to the apparatus casing 2, and urges weakly the pivot arm 62 via the pushing portion 62*c* of the pivot arm 62 such that the receiving portions 62*b* of the pivot arm 62 face the tape-trimming guide slit 14. The switch arm 63 in a wait state pushes up the pushing portion 62*c* by the spring force thereof and the switch body 64 in contact with the switch arm 63 is off. On the other hand, when the switch arm 63 is pushed down by the pushing portion 62*c* against the resilient properties thereof, the switch arm 63 pushes the switch body 64 to thereby turn the same on.

That is, when the printing tape T is properly inserted into the tape-trimming guide slit 14, the switch body 64 is turned on via the pivot arm 62 and the switch arm 63, whereas when the printing tape T is withdrawn from the tape-trimming guide slit 14, the switch body 64 is turned off. When the switch body 64 is turned on, a controller (CPU) 28 causes the motor 21 to rotate in the normal direction to hereby cause the cutter 51 to perform a cutting operation, whereas when the switch body 64 is turned off, the controller 28 causes the motor 21 to stop to thereby stop the cutting operation of the cutter 51. In other words, the printing tape T is inserted into the tape-trimming guide slit 14 to automatically operate the trimming mechanism 22 for trimming ends of a cut-off strip of the printing tape T into ones with a radius.

Next, the peeling mechanism 23 will be described. Referring to FIGS. 3, 4 and 6, the peeling mechanism 23 includes an intermediate gear 71 mated with the gear 43 of the aforementioned input-side clutch 41, an input gear 72 mated with the intermediate gear 71, and a peeling wheel 73 (rotational member) integrally formed with the input gear 72. On a top of the peeling wheel 73 there are arranged peeling projections 74 which rotate in union with the peeling wheel 73 to thereby bend or release an end (of the cut-off strip) of the printing tape T. The printing tape T is peeled at a corner by the repetition of this tape end-bending/releasing operation, while the tape-peeling guide slit (holding means) 15 holds the printing tape such that a portion to be peeled makes a free end Ta (see FIG. 8).

The intermediate gear 71 is rotatably supported on a support shaft 75 arranged between the lower frame 31 and the subframe 26. The input gear 72 and the peeling wheel 73 integral with the input gear 72 are rotatably supported on a shaft member 76 extending upward from the lower frame 31. The peeling wheel 73 is rotated by the gears 71, 72 in accordance with both normal and reverse rotations of the motor 21, and peels the printing tape T when the motor 21 rotates in the reverse direction (see FIG. 7). Now, before describing the construction of the peeling projections 74 in detail, the construction of the tape-peeling guide slit 15 facing the rotating peeling projections 74 will be described.

Figure 7:
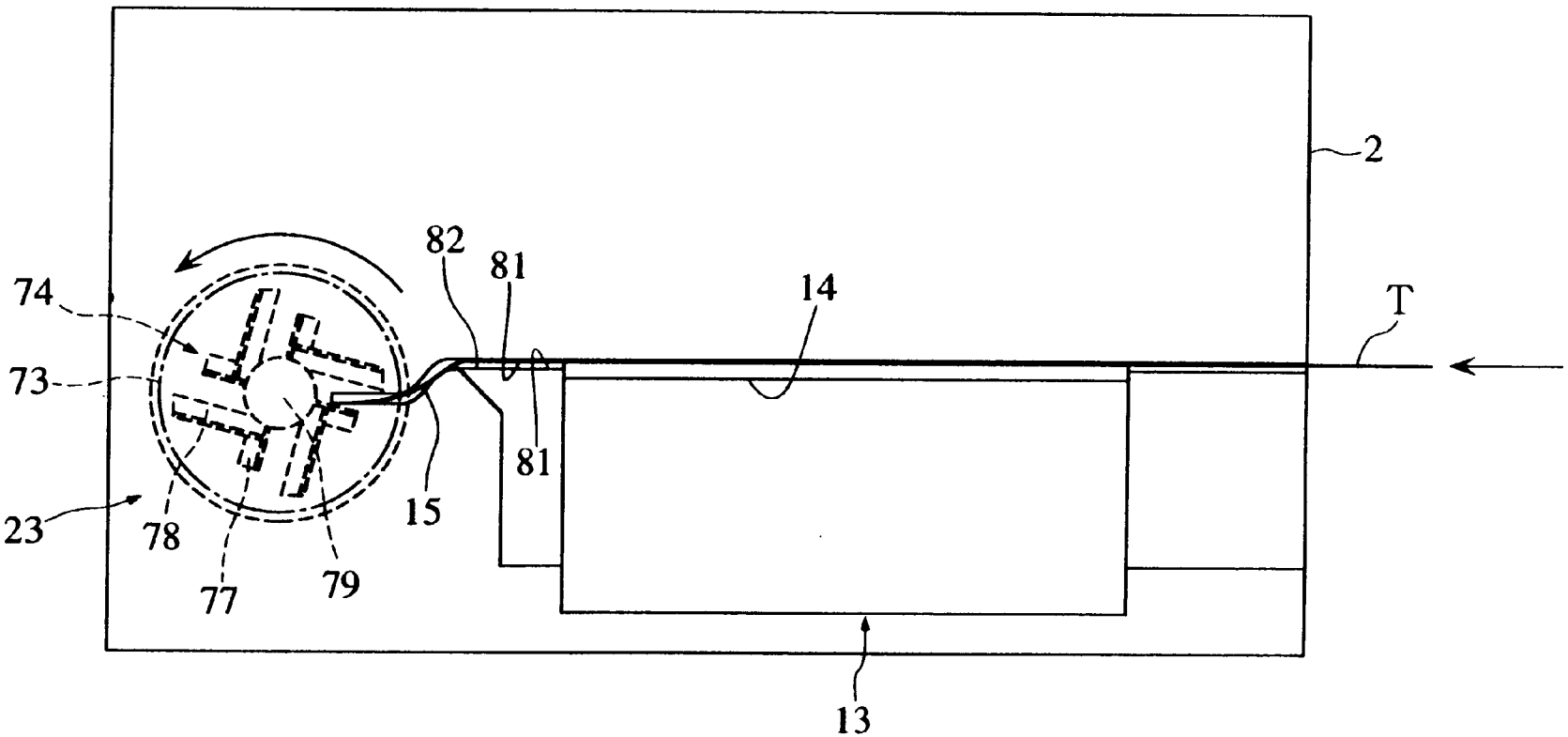
FIG. 7 is a plan view showing the relationship between a peeling projection and a tape-peeling guide slit of the tape processing device.

The tape-peeling guide slit 15 is integrally formed with the apparatus casing 2, which includes a pair of face guide walls 81, 81 for guiding the front and back of an inserted printing tape T, respectively, and a side guide wall 82 for guiding a lower side of the inserted printing tape T. The side guide wall 82 guides the printing tape T such that the printing tape T is guided along the top of the peeling wheel 73 to be brought to the peeling projections 74. Further, the pair of face guide walls 81, 81 are curved with respect to the direction of the insertion of the printing tape T to form a generally S shape, as shown in FIGS. 1, 7, and hence when the printing tape T is inserted therein, it is bent to form a S shape and its end portion (free end) is protruded substantially toward the axis of the peeling wheel 73 to face the peeling projections 74.

As described above, since the pair of face guide walls 81, 81 are curved, the whole part of the inserted printing tape T except the free end Ta facing the peeling projections 74 is held in a tightly stretched manner between the face guide walls 81, 81 by its rigidity. Therefore, the printing tape T can be held without using a particular holding member and at the same time smoothly inserted into the tape-peeling guide slit 15. Further, a portion opposed to the side guide wall 82, that is, a portion corresponding to an upper surface of the apparatus casing is open, which permits various types of printing tapes T to be inserted regardless of whether they have a large or small tape width, and at the same time the printing tape T to be withdraw upward(see FIG. 1). As described above, the printing tape T can be withdrawn upward, so that there is no need to withdraw the peeled-off printing tape T along the curved face guide wall 81, which makes it possible to prevent a peeled peel-off paper from adhering again to the substrate tape a.

It should be noted that the tape-peeling guide slit 15 and the direction of the rotation of the peeling projections 74 according to the present embodiment is designed assuming that the printing tape T is to be inserted with a printing surface thereof facing toward the front. This is because when dealing with printed tapes, the user generally tends to carry out operations while viewing printed surfaces, and the above configuration is adapted to this tendency of the user. Therefore, a guide message, not shown, is provided at the tape-peeling guide slit 15 to advise the user to insert an erected printing tape T with a substrate tape-side surface facing toward the front and a peel-off paper-side surface toward the back. On the other hand, the peeling projections 74 rotate to be brought into contact with the substrate tape-side to bend or flex the printing tape T (see FIG. 7), whereas the pair of face guide walls 81, 81 are generally bent in a direction opposite to the rotational direction of the peeling wheel 73 so that the peeling projections 74 bend or flex the printing tape T against a bending force applied to the same.

On the other hand, in this embodiment, a corner (one of the corners) of the end of the printing tape T is bent for peeling off the bent portion to form a triangular peeled-off portion. Therefore, there is provided a receiving member 83 having a sloped portion 83*a* which is disposed at an end of the face guide wall 81 on the peel-off paper-side (forward in the rotational direction) of the pair of face guide walls 81, 81 (see FIGS. 3 and 6). The sloped portion 83*a* of the receiving member 83 is opposed to the rotating peeling projections 74 to receive the printing tape T on the peel-off paper-side such that a portion of the free end Ta of the printing tape T, which is bent with the rotation of the peeling projections 74, assumes a triangular form. This makes it possible to positively peel a peel-off paper at a corner of the end of the printing tape T where the peel-off paper most readily starts to be peeled off the printing tape T.

As shown in FIG. 7, the peeling projections 74 are formed by four shorter projecting pieces 77 and four longer projecting pieces 78. The shorter projecting pieces 77 each extend radially from a circular projection 79 formed at a central portion of the top of the peeling wheel 73, whereas the longer projecting pieces 78 each extend at right angles to the shorter projecting pieces 77 from root portions of the same. The end portion of the printing tape T facing the longer projecting pieces 78 and the shorter projecting pieces 77 extends toward a position slightly deviating from the axis of the peeling wheel 73. The shorter projecting pieces 77 are rotated to be brought into contact with the end portion (free end Ta) of the printing tape T one after another from a tip side to a root side thereof to thereby bend the free end of the printing tape T from the tip side thereof. Similarly, the longer projecting pieces 78 extend on the top of the peeling wheel 73, substantially radially from positions deviating from the axis of the peeling wheel 73, and are rotated to be brought into contact with the free end Ta of the printing tape one after another from the tip side to the root side thereof to thereby bend the same from the tip side.

Adhesion of the adhesive b to the peel-off paper c is very weak, and hence in removing the peel-off paper c from the substrate tape a, it is effective to form a peeling start portion at which peeling is started, and then expand the peeled area over the whole free end Ta. Further, the free end Ta has a triangular shape and its affixing area for affixing the peel-off paper is sharply decreased toward the tip side, thereby permitting the peel-off paper to be removed with ease. Accordingly, the free end Ta of the printing tape T is bent from the tip side to the root side thereof, which makes it possible to accelerate the peeling on the tip side of the free end Ta. And, the tip side portion of the free end intensively receives tape end-bending/releasing actions (peeling actions) of the shorter projecting pieces 77, whereby it is possible to form the peeling start portion. Further, from this state, through peeling actions of the longer projecting pieces 78, the peeling spreads across the while free end Ta, whereby a portion of the peel-off paper is peeled off the free end Ta. At the same time, the longer projecting pieces 78 mainly comes into contact with one side (portion corresponding to a larger side of a rectangular cut-off strip of the printing tape T) of the free end Ta, whereas the shorter projecting pieces 77 mainly come into contact with the other side (portion corresponding to a shorter side of the rectangular cut-off strip of the printing tape T) of the free end Ta to thereby uniformly bend the whole free end Ta.

As described above, the peeling projections 74 are formed by a plurality of longer projecting pieces 78 and a plurality of shorter projecting pieces 77 and the peeling projections 74 are rotated to be brought into contact with the printing tape T one after another from the tip side to the root side thereof, which makes it possible to accelerate the peeling of the printing tape T. It should be noted that the peeling projections 74 may be formed by a plurality of longer projecting pieces 78 alone or by a single longer projecting piece 78.

Further, the longer projecting pieces 78 and the shorter projecting pieces 77 have contacting surfaces with the printing tape T formed at right angles to each other on the top of the peeling wheel 73, and at the same time the ends thereof are chamfered to face the sloped portion 83*a* of the above-mentioned receiving member 83 in parallel therewith (see FIGS. 3 and 6). In this case, to bend the end portion (free end Ta) of the printing tape T to an extent suitable for peeling, it is generally preferred (though depending on the material of the printing tape T) that the following formula is fulfilled:

$$t \leqq \delta \leqq 10t$$

wherein t represents thickness of the printing tape T, and δ represents a gap between the ends of the longer projecting pieces 78 and the sloped portion 83*a* opposed in parallel therewith. This makes it possible to utilize the rigidity of the substrate tape a in peeling a peel-off paper while preventing the substrate tape a from forming a habit of bending, which will be explained in detail hereinafter.

In the peeling mechanism 23 thus constructed, similarly to the trimming mechanism 22, it is required to drive the motor 21 in a reverse direction when the printing tape T is inserted into the tape-peeling guide slit 15. Therefore, the peeling mechanism 23 according to the present embodiment is provided with a peeling switch (reverse drive control means) 91. As shown in FIG. 4, the peeling switch 91 is comprised of a switch arm 92 pivotally mounted on an inner surface of the apparatus casing 2 above the peeling wheel 73 and a switch 93 in contact with the switch arm 92. The switch arm 92 is generally L-shaped, and a distal end thereof faces the curved portion of the tape-peeling guide slit 15, whereas a proximal end thereof is in contact with the switch 93.

The switch arm 92 in a wait state is urged by a spring, not shown, arranged in the switch 93 to have its distal end protruded toward the curved portion of the tape-peeling guide slit 15. When the printing tape T is inserted into the tape-peeling guide slit 15, the switch arm 92 is pushed by the end of the printing tape T to be rotated. When the switch arm 92 is rotated, the switch 93 is depressed against the urging force of spring arranged therein to be turned on. That is, when the printing tape T is inserted into the tape-peeling guide slit 15, the switch 93 is turned on via the switch arm 92. Inversely, when the printing tape T is withdrawn from the tape-peeling guide slit 15, the switch 93 is turned off. And, when the switch 93 is turned on, the controller (CPU) 28 causes the motor 21 to rotate inversely whereby the peeling wheel 73 is rotated to cause the peeling projections 74 to perform the peeling operation.

In this process, the motor 21 starts rotating when the leading end of the inserted printing tape T has reached the curved portion of the tape-peeling guide slit 15, so that when the leading end of the inserted printing tape T has reached a position (inside a rotation locus) of the peeling projections 74, the peeling projections 74 have already started the rotation thereof. Therefore, before the leading end of the printing tape T is deeply inserted toward the peeling projections 74, the end portion (free end Ta) of the printing tape T repeatedly receives peeling actions of the longer and shorter projecting pieces 77, 78, from the tip side to the root side thereof so that the peeling of the pee-off paper on the free end Ta is also accelerated by this construction.

Figure 13A:
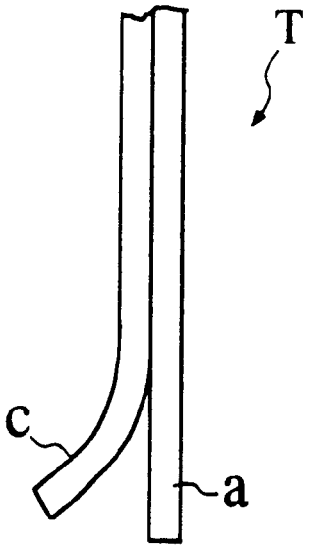
FIGS. 13A and 13B are plan views showing two manners of peeling of the peel-off paper off the printing tape.
Figure 13B:
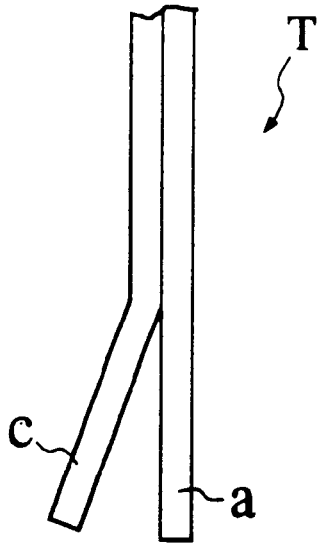

More specifically, during a time period over which the free end Ta of the printing tape T is guided inward of the rotation locus of the longer projecting and is deeply inserted therein, the free end Ta repeatedly receives peeling actions of the longer projecting pieces 78 (shorter projecting pieces 77). Accordingly, at the beginning of insertion, the printing tape Ta receives the peeling actions at the leading edge of the free end Ta which is easy to peel off, to thereby form a peeling start portion from which the peeling is spread across the whole area of the free end Ta. As a result, as shown in FIG. 13A, the peel-off paper c from the printing tape T in a manner bent roundly. On the other hand, if the longer projecting pieces 78 (short projecting pieces 77) starts to be rotated after the printing tape T has been inserted inward of the rotation locus of the longer projecting pieces 78, the peel-off paper c is peeled in a manner flexed angularly, as shown in FIG. 13B. In the Latter case, no peeling start portion is formed, and hence exhibits slightly inferior peeling performance.

The peeling switch 91 may be formed of an optical sensor or the like. Further, so long as the longer projecting pieces 78 starts to be rotated before the free end Ta of the printing tape T enters the inside of the rotation locus of the longer projecting pieces 78, the peeling switch 91 may be disposed in any suitable position or have any suitable construction.

Figure 8:
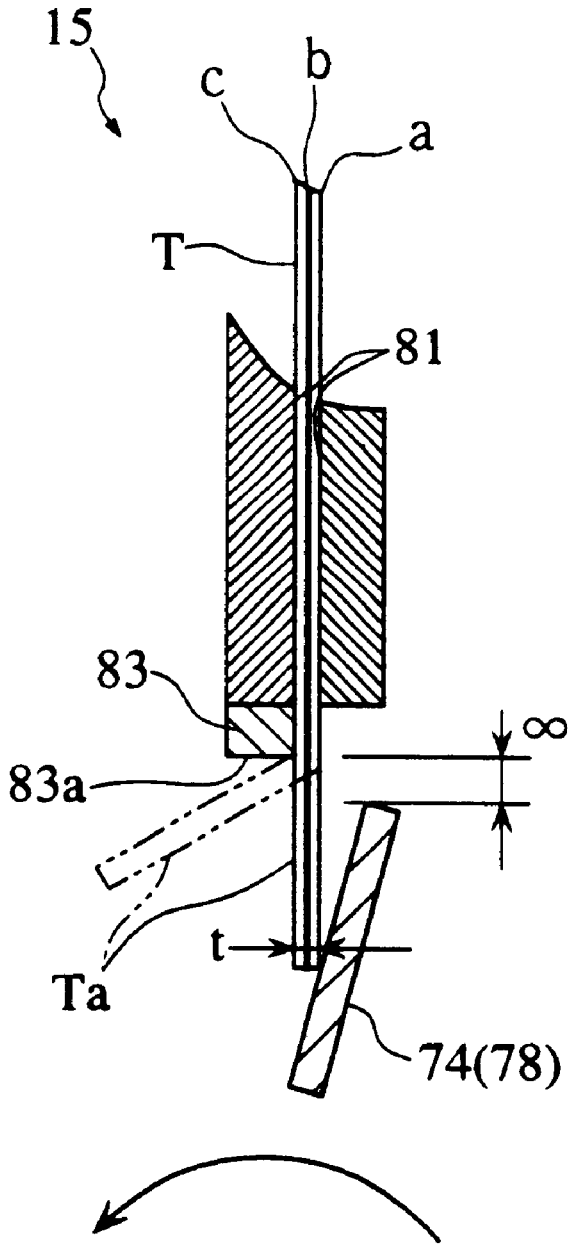
FIG. 8 is a plan view which is useful in explaining how a peel-off paper starts to be peeled off from the printing tape.

Next, referring to FIGS. 8 and 9, the printing tape T-peeling actions of the peeling projections 74 will be described in further detail by taking one of the longer projecting pieces 78 as an example. As shown in FIG. 8, the printing tape T except for the free end Ta is held by the face guide walls 81, 81 of the tape-peeling guide slit 15 and the receiving member 83, and the longer projecting piece 78 rotated is brought into contact with the free end Ta. The longer projecting piece 78 brought into contact with the substrate tape-side portion of the printing tape T, as described hereinabove, and starts to bend the printing tape T. This causes the free end Ta of the printing tape T to be bent with the substrate tape a side outward and the peel-off paper c side inward. As illustrated in FIG. 9, the printing tape T is bent at the free end Ta about the sloped portion 83*a* of the receiving member 83 receiving the printing tape T and hence the substrate tape a is bent at a larger radius of curvature (R), whereas the peel-off paper c is bent at a smaller radius of curvature (R). Therefore, as the bending proceeds, there occurs an interlayer slip between the adhesive band the peel-off paper c, which causes the adhesive b to be extremely decreased in adhesion to the peel-off paper c.

Further, after the bend at the free end Ta was reached its maximum, the end of the longer projecting piece 78 is moved away from the tip of the free end Ta in a manner following the same, which causes the free end Ta to return to its original position in a sprung-up manner. On this occasion, the peel-off paper c is protruded from the substrate tape a. Therefore, the end of the longer projecting piece 78 is first detached from the substrate tape a, and then from the peel-off paper c. When the end of the longer projecting piece 78 is moved away from the substrate tape a, the substrate tape a starts to return to its original position by the spring force of its own against the adhesion of the adhesive b to the peel-off paper c. At this time point, if the spring force of the substrate tape a exceeds the adhesion of the adhesive b reduced through the interlayer slip, the peel-off paper c is removed or peeled from the substrate tape a. Even if the peel-off paper c is not peeled from the substrate tape a, the adhesion of the adhesive b is still more reduced, so that the peel-off paper c is eventually peeled off from the substrate tape a by repeated peeling actions.

Figure 10:
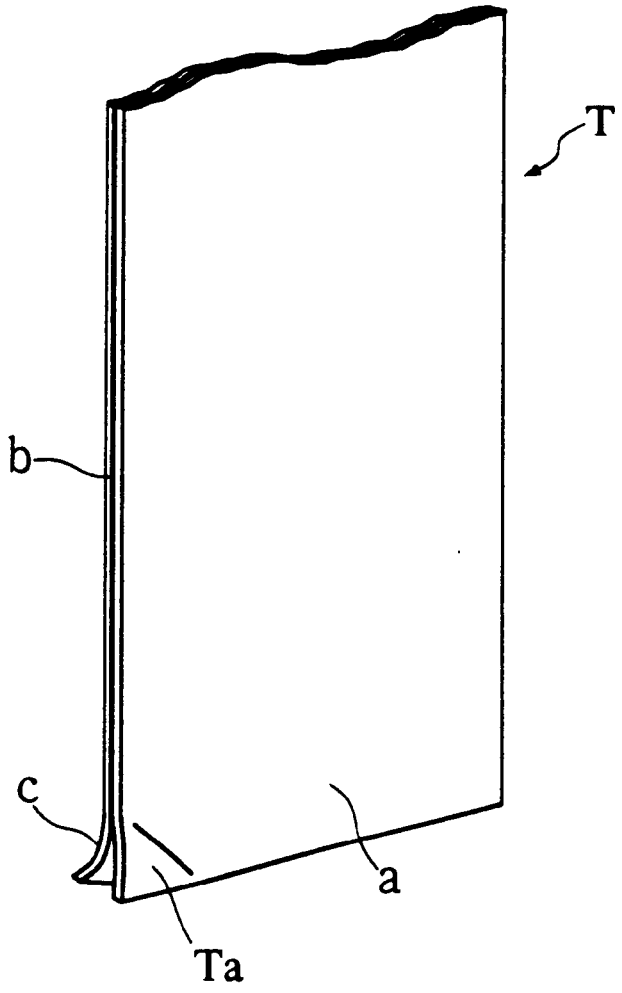
FIG. 10 is a perspective view showing a state in which the peel-off paper started to be peeled off from the printing tape by the tape processing device.

On the other hand, during a time period from a time point the longer projecting piece 78 is moved away from the substrate tape a to a time point the same is moved away from the peel-off paper c, the peel-off paper c is more deeply bent than the substrate tape a since the former is slightly protruded from the latter. The bending (flexure) of the free end Ta of the printing tape T caused by the longer projecting piece 78 is set such that the bending of the substrate tape a is within the limit of elastic deformation, and at the same time the bending of the peel-off paper c reaches the range of permanent deformation. Therefore, after bending by the longer projecting piece 78 is canceled, as shown in FIG. 10, the substrate tape a returns to its original linear position, whereas the peel-off paper c does not return to its original linear position to be kept in the habit of bending. Therefore, the peel-off paper c once bent and peeled off from the printing tape T does not adhere again to (the adhesive b of) the substrate tape a, to complete the peeling.

Figure 14:
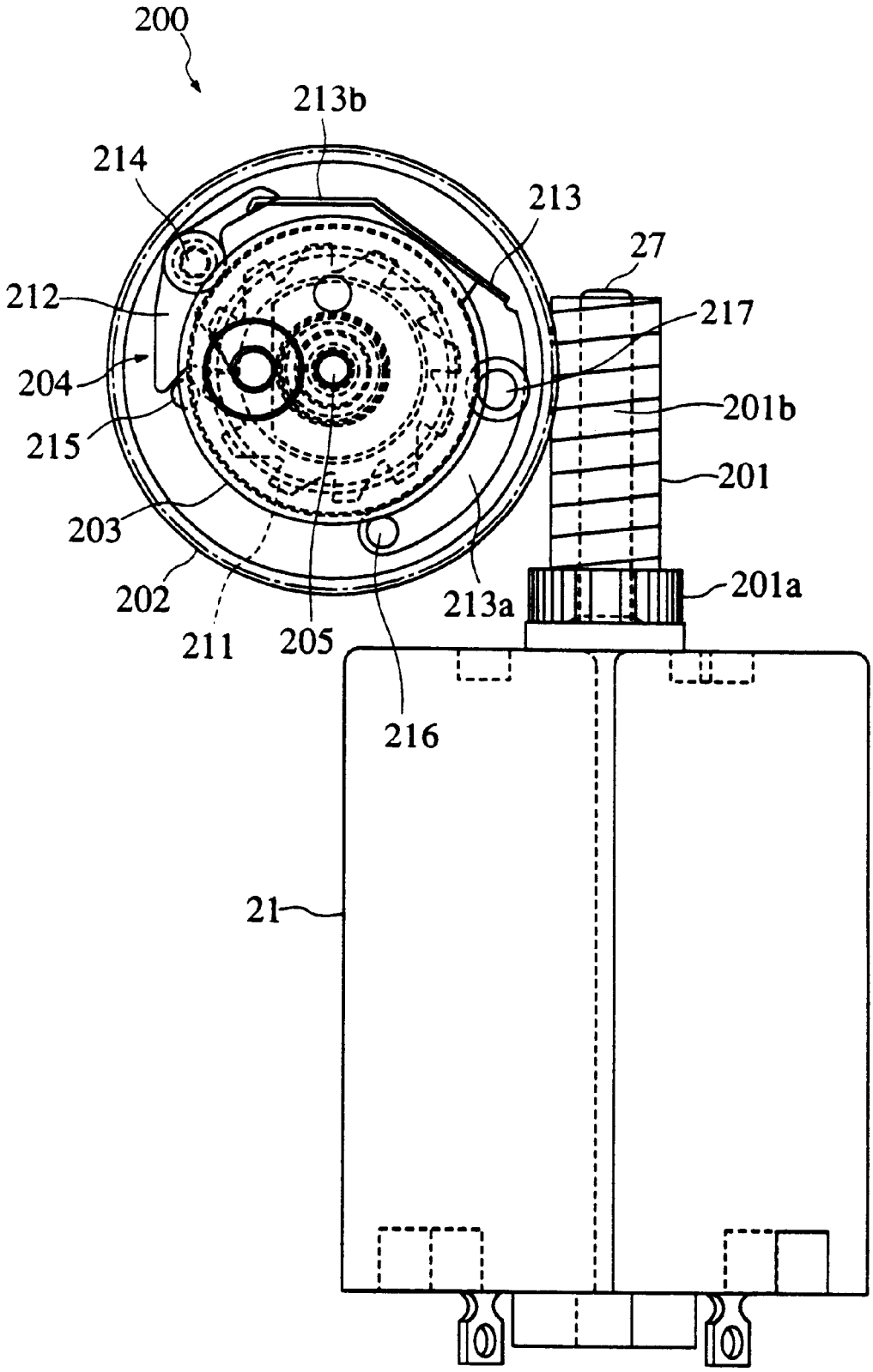
FIG. 14 is a rear elevational view of a clutch mechanism and component parts associated therewith, according to a second embodiment of the invention.
Figure 15:
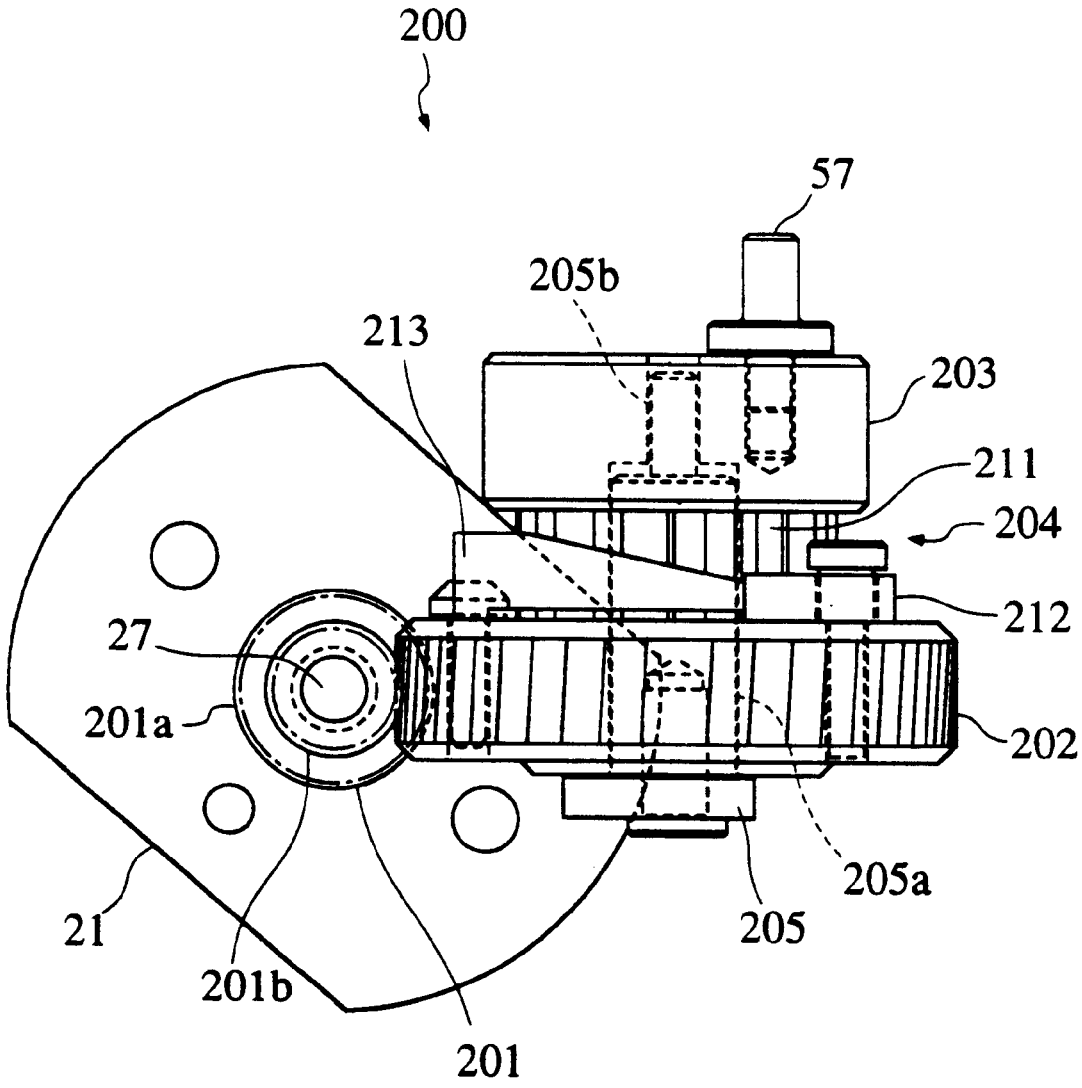
FIG. 15 is a plan view of the clutch mechanism and component parts associated therewith, according to the second embodiment.
Figure 16:
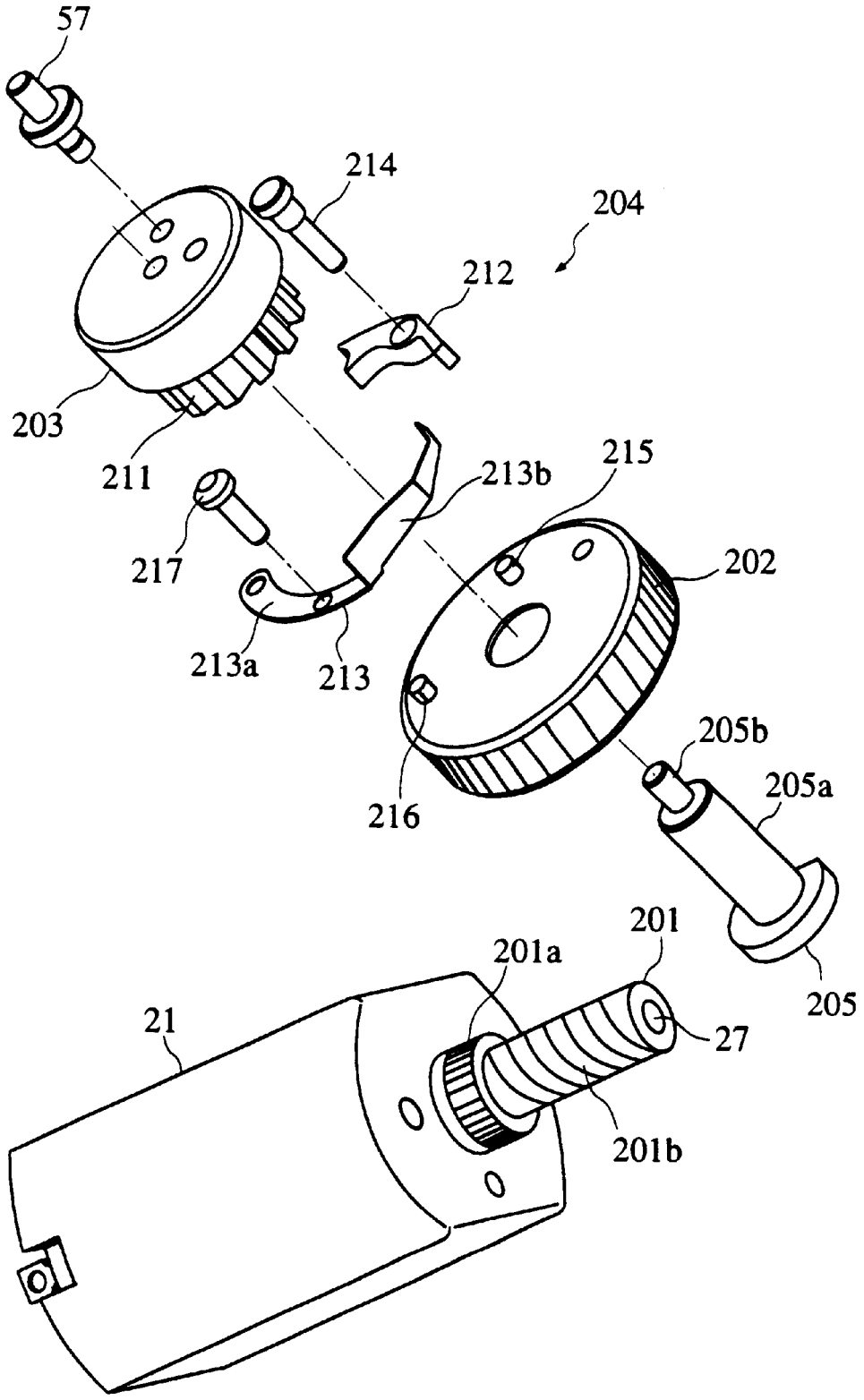
FIG. 16 is an exploded perspective view of the clutch mechanism and component parts associated therewith, according to the second embodiment.

Next, a second embodiment of the invention will be described with reference to FIGS. 14 to 16. This embodiment is distinguished from the first embodiment in the construction of a clutch mechanism, whereas the other component elements and parts of the second embodiment are similar to those of the first embodiment. Therefore, members corresponding to those of the first embodiment are designated by identical reference numerals, and detailed description thereof is omitted.

As shown in the figures, the clutch mechanism 200 includes a first gear 201 fixed to a drive shaft 27 of a motor 21, a second gear 202 mated with the first gear 201, an output wheel 203 arranged coaxially with the second gear 202, and a clutch 204 interposed between the second gear 202 and the output wheel 203.

The first gear 201 is a spur gear (output block) 201*a* on the motor 21-side and a worm 201*b* on the second gear 202-side integrally formed with the spur gear 201*a*. The spur gear 201*a* corresponds to the gear 43 in the first embodiment and the driving force of the motor 21 is transmitted from the spur gear 201*a* to the peeling mechanism 23. The second gear 202 is formed of a worm wheel mated with the worm 201*b*, and worm gears are constituted by the worm 201*b* of the first gear 201 and the second gear 202. The second gear 202 is rotatably supported on a large-diameter portion 205*a* of a shaft member 205 extending backward from the connecting frame 33, while the output wheel 203 is rotatably supported on a small-diameter portion 205*b* of the shaft member 205. The output wheel 203 corresponds to the crank wheel 56 in the first embodiment, and similarly to the first embodiment, it has an eccentric pin 57 on an end surfaces thereof (the second gear 202 and the output wheel 203 will be described in detail hereinafter).

The clutch 204 has a ratchet wheel 211 integrally formed with the output wheel 203 on an end face opposite to an end face formed the eccentric pin 57, a ratchet pawl 212 attached to the second gear 202 in a manner opposed to the ratchet wheel 211, and a leaf spring 213 urging the ratchet pawl 212 toward the ratchet wheel 211.

The ratchet pawl 212 is pivotally mounted on an end face of the second gear 202 by a shaft pin 214 extending through an intermediate portion thereof. Further, on the same end face of the second gear 202, there is formed a stopper pin 215 in engagement with an end of the ratchet pawl 212 so as to control the depth of mating of the ratchet pawl 212 with the ratchet wheel 211. The leaf spring 213 is made by bending of a plate material first shaped into a predetermined form by blanking with a press, and is comprised of an arcuate mounting portion 213*a*, a spring 213*b* arranged in a manner rising at a right angle to the tip of the mounting portion 213*a* and extending forward. The mounting portion 213*a* is arranged on the end face of the second gear 202 along its rim and fixed to the second gear 202 by an embedded pin 216 and a mounting pin 217 in a positioned state. The spring 213*b* is bent inward at an intermediate portion thereof, and has a tip thereof engaged with a tail end of the ratchet pawl 212 to urge the ratchet pawl 212 such that the ratchet pawl 212 is mated with the ratchet wheel 211.

According to the above-mentioned construction of the clutch mechanism 200, when the motor 21 rotates in the normal direction, the ratchet pawl 212 urged by the leaf spring 213 is mated with the ratchet wheel 211 to transmit the torque of the second gear 202 to the output wheel 203, whereby the second gear 202 and the output wheel 203 are rotated in unison. Inversely, when the motor 21 rotates in the reverse direction, the ratchet pawl 212 turns free in a manner flicked along the surface of the ratchet wheel 211 against the urging force of the leaf spring 213, whereby the transmission of the driving force 5 is cut off.

As described above, according to the second embodiment, through combination of the ratchet wheel 211 and the ratchet pawl 212, a clutch mechanism for transmitting the rotating force only in one direction can be easily constructed.

The above clutch mechanism 24 can be applied as a one-way clutch to various kinds of mechanisms other than this kind of electronic apparatus.

It is further understood by those skilled in the art that the foregoing are preferred embodiments of the invention, and that various changes and modification may be made without departing from the spirit and scope thereof.

What is claimed is:

1. A tape processing device for processing a peel-off paper-backed adhesive tape, said tape processing device comprising:

a trimming mechanism for trimming an end of said peel-off paper-backed adhesive tape;

a peeling mechanism for peeling off a peel-off paper from said peel-off paper-backed adhesive tape;

single driving means for driving said trimming mechanism and said peeling mechanism; and driving force-transmitting means for transmitting driving force from said driving means to said trimming mechanism and said peeling mechanism;

said peeling mechanism peeling off the peel-off paper through rotation into contact with a free portion of an end of said adhesive tape, to thereby carry out a bending and releasing action on said free portion of said end of said adhesive tape.

2. A tape processing device for processing a peel-off paper-backed adhesive tape, said tape processing device comprising:

a trimming mechanism for trimming an end of said peel-off paper-backed adhesive tape;

a peeling mechanism for peeling off a peel-off paper from said peel-off paper-backed adhesive tape;

single driving means for driving said trimming mechanism and said peeling mechanism; and driving force-transmitting means for transmitting driving force from said driving means to said trimming mechanism and said peeling mechanism;

said driving means including a drive shaft and a motor for rotating said drive shaft, said driving force-transmitting means having a one-way clutch having an input-side thereof fixed to said drive shaft and an output-side thereof connected to said trimming mechanism to thereby transmit only torque in a normal direction to said trimming mechanism.

3. A tape processing device according to claim 2, wherein said one-way clutch comprises a first gear fixed to said drive shaft, a second gear mated with said first gear, an output wheel arranged coaxially with said second gear with an output-side thereof being connected to said trimming mechanism, and a clutch body interposed between said second gear and said output wheel to transmit only said torque in said normal direction from said motor to said trimming mechanism.

4. A tape processing device according to claim 3, wherein said clutch body has a ratchet wheel arranged on one of said second gear and said output wheel, a ratchet pawl pivotally arranged on another of said second gear and said output wheel for being mated with said ratchet wheel, and a spring urging said ratchet pawl in a mating direction.

5. A tape processing device according to claim 3, wherein said trimming mechanism includes a crank mechanism for converting rotation of said output wheel into reciprocation, and a cutter actuated by said reciprocation of said crank mechanism, for a cutting operation.

6. A tape processing device according to claim 3, wherein said first gear further includes an output block for transmitting both said torque in said normal direction and torque in a reverse direction from said motor to said peeling mechanism.

7. A tape processing device according to claim 2, wherein said one-way clutch comprises an input-side face ratchet fixed to said drive shaft and an output-side face ratchet rotatably and axially slidably supported on said drive shaft.

8. A tape processing device according to claim 7, wherein said output-side face ratchet has a worm on an output-side thereof, said trimming mechanism having a worm wheel mated with said worm on an input-side thereof, and wherein a viscous material is filled between said drive shaft and said worm, for causing said worm to rotate in a free-running manner with rotation of said drive shaft.

9. A tape processing device according to claim 8, further including a stopper for limiting movement of said worm in an axial direction in a manner such that said worm is mated with said worm wheel in a state in which said input-side face ratchet and said output-side face ratchet are disengaged from each other.

10. A tape processing device according to claim 8, wherein said trimming mechanism includes a crank mechanism for converting rotation of said worm wheel into reciprocation, and a cutter actuated by said reciprocation of said crack mechanism, for a cutting operation.

11. A tape processing device according to claim 7, wherein said input-side face ratchet further includes an output block for transmitting both said torque in said normal direction and torque in a reverse direction from said motor to said peeling mechanism.

12. A tape processing device for processing a peel-off paper-backed adhesive tape, said tape processing device comprising:

a trimming mechanism for trimming an end of said peel-off paper-backed adhesive tape;

a peeling mechanism for peeling off a peel-off paper from said peel-off paper-backed adhesive tape;

single driving means for driving said trimming mechanism and said peeling mechanism;

driving force-transmitting means for transmitting driving force from said driving means to said trimming mechanism and said peeling mechanism; and a device casing formed with a trimming guide slit for guiding said peel-off paper-backed adhesive tape inserted therein to said trimming mechanism and a peeling guide slit for guiding said peel-off paper-backed adhesive tape inserted therein to said peeling mechanism, said trimming guide slit and said peeling guide slit being arranged adjacent to each other.

13. A tape processing device according to claim 12, wherein said trimming guide slit and said peeling guide slit are different in direction of inserting said peel-off paper-backed adhesive tape.

14. A tape processing device according to claim 12, further including normal rotation control means for detecting said peel-off paper-backed adhesive tape inserted into said trimming guide slit to thereby cause said motor to rotate in a normal direction.

15. A tape processing device according to claim 12, further including inverse rotation control means for detecting said peel-off paper-backed adhesive tape inserted into said peeling guide slit to thereby cause said motor to rotate in a reverse direction.

16. A tape printing apparatus which is capable of using a peel-off paper-backed adhesive tape, said tape printing apparatus comprising:

printing means for printing said peel-off paper-backed adhesive tape;

cutter means for cutting off said peel-off paper-backed adhesive tape to a predetermined length;

tape-feeding means for bringing said peel-off paper-backed adhesive tape printed by said printing means to said cutter means and sending said peel-off paper-backed adhesive tape out of said tape printing apparatus; and a tape processing device for processing said peel-off paper-backed adhesive tape cut to said predetermined length, said tape processing device including:

a trimming mechanism for trimming an end of said peel-off paper-backed adhesive tape cut to said predetermined length, a peeling mechanism for peeling off a peel-off paper from said peel-off paper-backed adhesive tape cut to said predetermined length, single driving means for driving said trimming mechanism and said peeling mechanism, and driving force-transmitting means for transmitting driving force from said driving means to said trimming mechanism and said peeling mechanism;

said peeling mechanism peeling off the peel-off paper through rotation into contact with a free portion of an end of said adhesive tape, to thereby carry out a bending and releasing action on said free portion of said end of said adhesive tape.

* * * * *